US010203187B1

(12) United States Patent
Bay

(10) Patent No.: US 10,203,187 B1
(45) Date of Patent: Feb. 12, 2019

(54) ARCHERY NOCK SYSTEM

(71) Applicant: Clean-Shot Archery, Inc., Renton, WA (US)

(72) Inventor: Larry R. Bay, Renton, WA (US)

(73) Assignee: Clean-Shot Archery, Inc., Seattle, WA (US)

( * ) Notice: Subject to any disclaimer, the term of this patent is extended or adjusted under 35 U.S.C. 154(b) by 0 days.

(21) Appl. No.: 15/963,062

(22) Filed: Apr. 25, 2018

Related U.S. Application Data

(60) Provisional application No. 62/490,012, filed on Apr. 25, 2017, provisional application No. 62/598,825, filed on Dec. 14, 2017.

(51) Int. Cl.
*F42B 6/06* (2006.01)
*F42B 12/42* (2006.01)
*F21Y 115/10* (2016.01)

(52) U.S. Cl.
CPC ..... *F42B 6/06* (2013.01); *F42B 12/42* (2013.01); *F21Y 2115/10* (2016.08)

(58) Field of Classification Search
CPC ..... F42B 6/06
See application file for complete search history.

(56) References Cited

U.S. PATENT DOCUMENTS

| | | | | |
|---|---|---|---|---|
| 9,546,851 | B2 * | 1/2017 | Kim | F42B 12/382 |
| 9,702,672 | B1 * | 7/2017 | Kim | F42B 6/06 |
| 9,733,051 | B2 * | 8/2017 | Bay | F42B 6/06 |
| 10,001,353 | B1 * | 6/2018 | Godsey | F42B 6/06 |
| 2018/0231359 | A1 * | 8/2018 | Yehle | F42B 6/06 |

* cited by examiner

*Primary Examiner* — John Ricci
(74) *Attorney, Agent, or Firm* — Skaar Ulbrich Macari, P.A.

(57) ABSTRACT

An archery nock system includes a bushing and a nock assembly. A hollow interior of the bushing can define a first inner diameter region, a reduced inner diameter region, a sloped inner diameter region and an expanded inner diameter region. A diameter of the reduced inner diameter region is smaller than that of the first inner diameter region. The diameter of the reduced inner diameter region is smaller than that of the expanded inner diameter region. The first inner diameter region is located longitudinally between the reduced inner diameter region and the proximal end of the bushing. The expanded inner diameter region is located longitudinally between the reduced inner diameter region and the distal end of the bushing. The sloped inner diameter region spans longitudinally between the reduced inner diameter region and the expanded inner diameter region. An LED turn ON force can be greater than the turn OFF force.

20 Claims, 31 Drawing Sheets

ARCHERY NOCK SYSTEM

PRIORITY

This application claims the priority benefit of U.S. Provisional Application No. 62/490,012, filed on Apr. 25, 2017 and U.S. Provisional Application No. 62/598,825, filed on Dec. 14, 2017. Both of the foregoing applications and all appendices thereto are hereby incorporated herein by reference in their entirety.

FIELD

The present invention relates to archery equipment, and more particularly, to replaceable nocks that can be used with crossbow shafts (bolts) and/or vertical bow shafts.

BACKGROUND

The use of nocks for archery is known. Many archers prefer to use lighted nocks because they allow the archer to track the flight of the arrow to their intended target, particularly in low-light conditions. Lighted nocks are typically lighted with a light emitting diode (LED) powered by a small battery, typically lithium-type, disposed within the nock assembly. The nock is either clear or translucent so that the LED light source can light up the nock when the battery power is applied.

Many lighted nocks use a cylindrical battery/LED component disposed in the nock assembly to light up the nock and power the light emitting diode (LED) light. This LED/battery component has a finite life. Thus, the user may wish to replace the battery/LED assembly or part of the nock system when the battery is spent. Thus, the nock designer has the competing challenges of designing a nock system that remains secure in the shaft or bolt while still permitting removal of a replaceable component when desired by the user.

Also, archers may wish to selectively replace the lighted nock with a non-lighted nock that has equivalent performance characteristics. There are no such nock systems currently available.

SUMMARY

Disclosed is a nock system, device, components and methods that allow for removal of the nock assembly while also providing a secure retention in the arrow shaft or crossbow bolt.

The disclosure includes an archery nock system including a bushing and a nock assembly. The bushing has a hollow interior, a proximal end and a distal end opposite the proximal end. The hollow interior defines a first inner diameter region, a reduced inner diameter region, a sloped inner diameter region and an expanded inner diameter region. The nock assembly defines an outer shape that permits a portion of the nock assembly to be disposed within the hollow interior of the bushing via insertion through the proximal end of the bushing. A diameter of the reduced inner diameter region is smaller than a diameter of the first inner diameter region. The diameter of the reduced inner diameter region is smaller than a diameter of the expanded inner diameter region. The first inner diameter region is located longitudinally between the reduced inner diameter region and the proximal end of the bushing. The expanded inner diameter region is located longitudinally between the reduced inner diameter region and the distal end of the bushing. The sloped inner diameter region spans longitudinally between the reduced inner diameter region and the expanded inner diameter region.

The diameter of the first inner diameter region can be smaller than the diameter of the expanded inner diameter region. An aperture can be defined at the proximal end of the bushing that has a diameter that is the same as the diameter of the first inner diameter region. The sloped inner diameter region can have a slope of 15 degrees. The nock assembly can include a light emitting diode disposed within the nock assembly.

The nock end can include a collimating lens and/or a diffuser disposed therein.

A stop tab can be disposed in an activation gap defined axially into the nock assembly.

The hollow interior of the bushing can define a first registration feature and the nock assembly can define a complimentary second registration feature configured to engage the first registration feature of the bushing while the nock assembly is being inserted into the proximal end of the bushing in a correct axial orientation.

Where the nock assembly is a lighted nock, the first and second registration features can be configured to maintain the correct axial orientation while a nock end of the nock assembly is moved longitudinally towards and away from the proximal end of the bushing to turn the lighted nock on and off.

The hollow interior of the bushing can define a longitudinally extending recess and the nock assembly can define a longitudinally-oriented raised rib sized to engage the longitudinally extending recess while the nock assembly is being inserted into the proximal end of the bushing in a correct axial orientation.

The nock assembly can include a battery stop, a nock end and a battery/LED component. The LED portion can be secured inside of the nock end and the battery portion can be secured inside of the battery stop. The nock end is linearly movable towards and away from the battery stop to turn the LED on and off.

The battery stop can include a head portion and a shank portion, and a plurality of grooves can be defined longitudinally into the head portion to define a plurality of flexible finger portions. Each of the plurality of flexible finger portions can include an outer rib.

The nock end can include a string engaging portion and a shank portion. The shank portion can include a compression groove defined longitudinally into the shank portion from an end of the shank portion.

The disclosure also includes a method of using an archery nock with a hollow bushing that is installed into an arrow shaft or a crossbow bolt. A minimum insertion force required to seat the archery nock in the hollow bushing, a minimum removal force required to remove the archery nock from the hollow bushing, a minimum turn ON force required to turn ON an LED disposed within the archery nock, and a minimum turn OFF force required to turn the LED OFF are each set. The minimum turn ON force is greater than each of the minimum turn OFF force, the minimum insertion force and the minimum removal force. The minimum removal force is greater than the minimum turn OFF force. The archery nock is inserted into the hollow bushing with at least the minimum insertion force. The LED is turned ON by pushing a nock end portion of the archery nock in a direction towards the hollow bushing with at least the minimum turn ON force. The LED is turned OFF by pulling the nock end portion in a direction away from the hollow bushing with at least the minimum turn OFF force. The archery nock is removed from the hollow bushing by pulling the nock end portion in the direction away from the hollow bushing with at least the minimum removal force.

The minimum turn ON force can be multiple times greater than the minimum turn OFF force. Light emitted by the LED when in an ON state can be collimated with a collimating lens provided to the nock end portion of the archery nock. Light emitted by the LED can be passed through a diffuser provided to the nock end portion of the archery nock.

After removing the archery nock from the hollow bushing, a non-lightable nock assembly can be inserted into the hollow bushing.

The minimum turn ON force can be set by compressing a grooved end of a shank of the nock end portion with a reduced inner diameter region defined by an inner surface of the hollow bushing.

The lighted nock component can be replaced with a non-lighted component that has equivalent performance characteristics, such as weight, so that the archer can selectively change between lighted and non-lighted versions of the nock while using the same arrow shaft or crossbow bolt.

The disclosure additionally includes a hollow bushing that is secured within the hollow rear or distal end of the arrow/bolt shaft. A lighted nock assembly includes a distal portion that includes a groove where a resilient member, such as a rubber O-ring, is retained. The groove depth and O-ring diameter is selected so that the outer diameter of the O-ring in its uncompressed state is larger than the inner diameter of the distal end of the bushing. Thus, when the nock assembly is installed within the bushing, the O-ring engages a shoulder portion of the bushing to prevent undesired movement of the nock assembly in the distal direction. If desired, the user can firmly pull the nock assembly in the distal direction to remove the nock assembly from the bushing. A new nock assembly can then be replaced into the bushing, or alternatively, the battery/LED component can be replaced in the removed nock assembly and then re-inserted into the bushing.

A stop tab can be provided to block the activation gap from closing between the nock end and the nock receiver during transport or storage.

The disclosure still further includes a nock system that allows for removal of the nock assembly while also providing a secure retention in the arrow shaft or bolt. A hollow bushing can be secured within the hollow rear or distal end of the arrow or bolt. A circumferential groove defined into the inner surface of the bushing engages with raised ribs of resilient finger portions to secure the nock assembly in place. Registration features on the assembly and the bushing ensure that the rotational alignment of the nock end is maintained. If desired, the user can firmly pull the nock assembly in the distal direction to remove the nock assembly from the bushing. Lighted and non-lighted nock assemblies for a given arrow shaft or crossbow bolt each have equivalent performance characteristics and can be swapped for one another utilizing the same bushing configuration.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
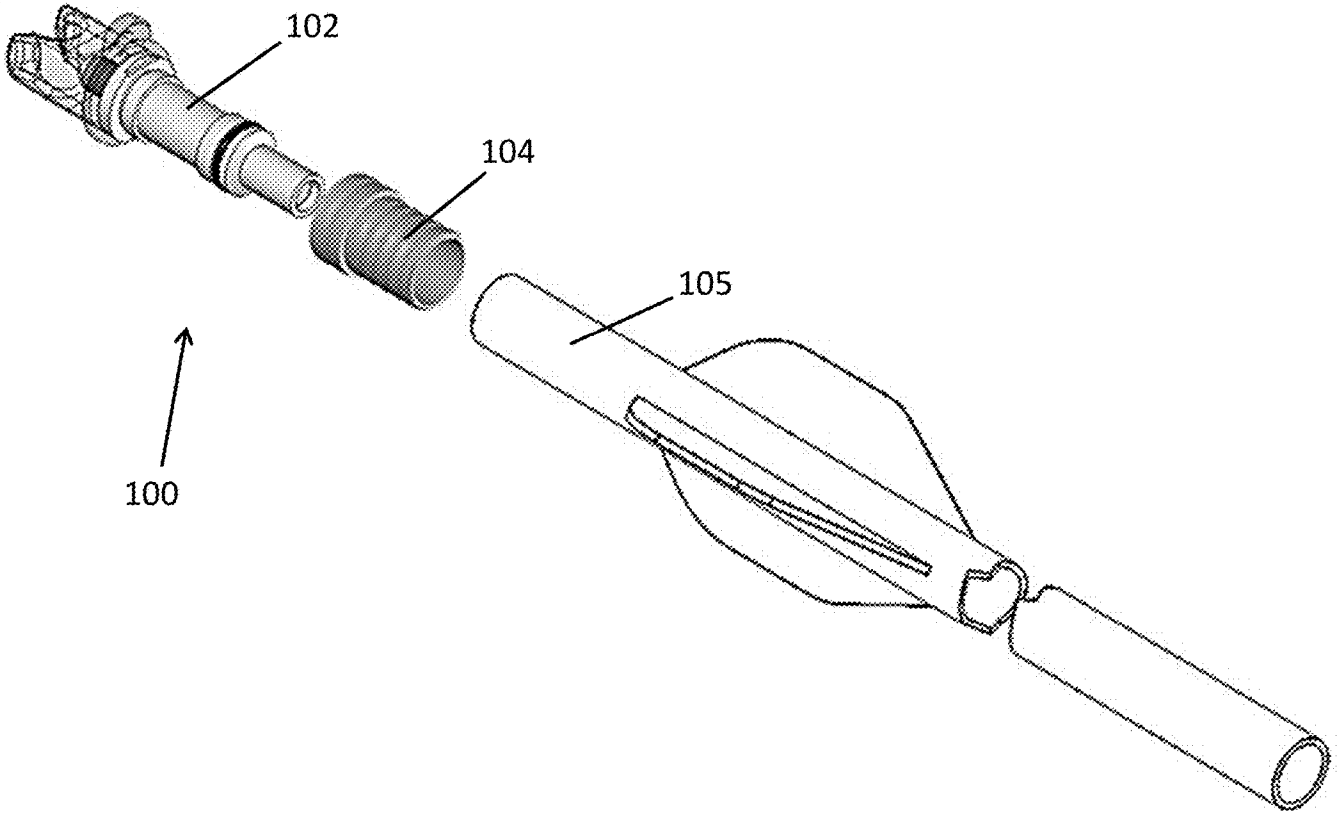
FIG. 1 is a perspective assembly view of a lighted nock system according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention. It is understood that the various features and aspects discussed herein may be used in any combination, or in isolation, without departing from the scope of the present invention.

The present invention can be configured for universal fit and include other features of the lighted nock system disclosed in U.S. Pat. No. 8,777,786, entitled "LIGHTED NOCK" which is hereby incorporated herein by reference in its entirety.

In addition, the present lighted nock system can be provided with the componentry and functionality according to the lighted nock system disclosed in U.S. Patent Application Publication No. 2017/0045343 A1, entitled "COLOR CHANGING LIGHTED NOCK FOR ARROW SHAFTS" which is hereby incorporated herein by reference in its entirety.

The nock systems, devices, features and aspects disclosed herein can be adapted to either cross bow bolts or arrow shafts without departing from the scope of the invention.

Referring first to FIG. 1, a lighted nock system 100 generally comprises a hollow bushing 104 that is secured within the hollow rear (distal) end of the arrow or bolt shaft 105 and a nock assembly 102 that fits into the inner diameter of the bushing 104.

The bushing can be secured in the shaft or bolt 105 with glue, interference frictional fit or other suitable means. The bushing 104 is intended to remain secured within the end of the shaft/bolt 105 and not be removed. The bushing 104 can be secured within the arrow/bolt shaft 105 as part of the bolt/arrow shaft manufacturing process or by a user.

Figure 2:
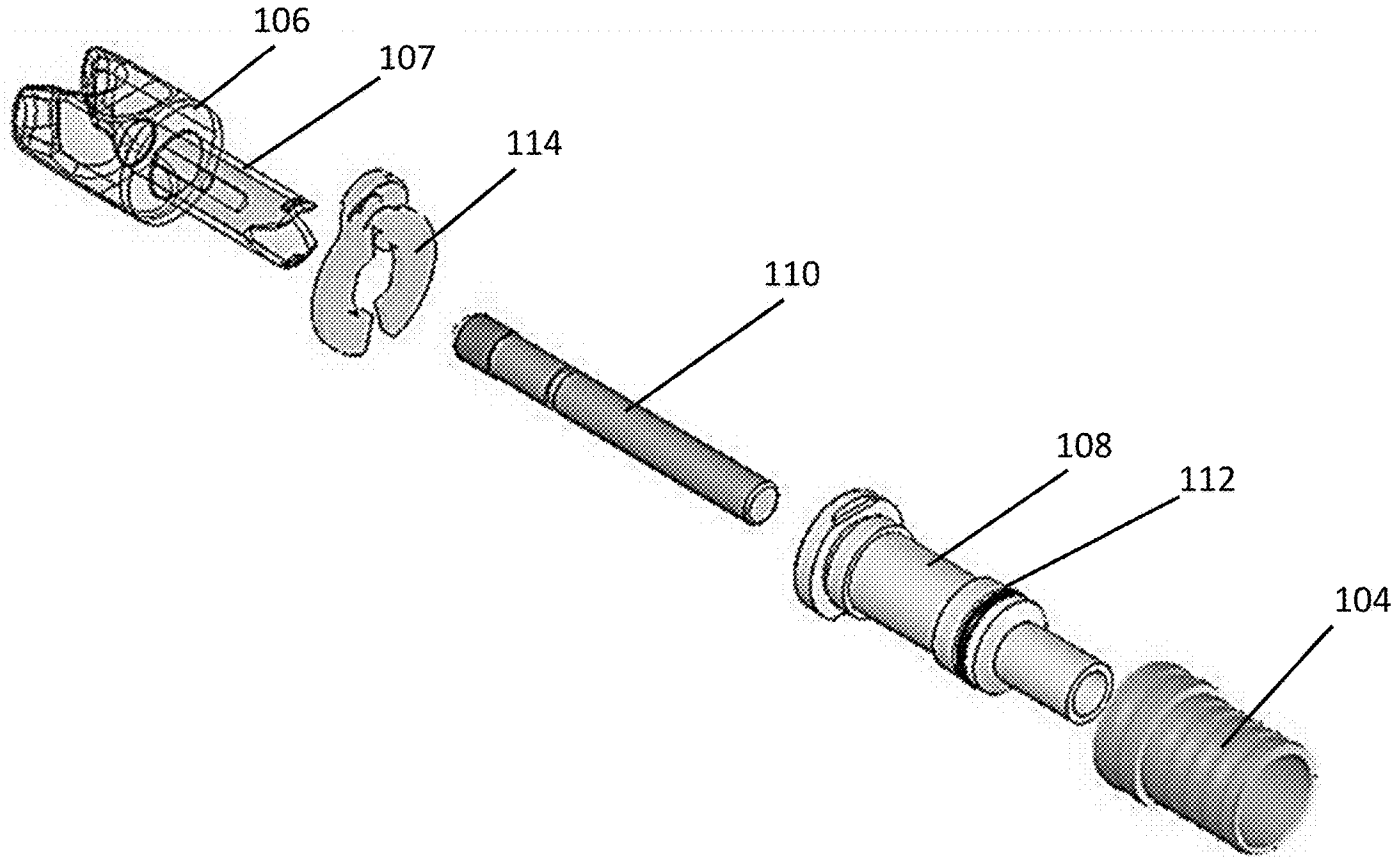
FIG. 2 is a perspective assembly view of a lighted nock system according to certain embodiments.

Referring next to FIG. 2, the nock assembly 102 of FIG. 1 includes a nock end 106 and nock receiver 108 with a battery/LED assembly 110 disposed partial in each of the nock and receiver. The forward shank portion 107 of the nock 106 fits into the inside hollow diameter of the receiver 108. The LED end of the battery/LED component 110 fits inside of the hollow shank and is secured into the nock 106. The battery end of the battery/LED component 110 is inserted into the hollow inside of the receiver 108 and secured into the receiver 108. The securing can be performed with glue, a fastener, mechanical locking or other suitable means.

The nock end 106 and nock receiver 108 can also be formed as an integrated unit where the forward proximal end, or shank, 107 of the nock receiver 108 is the shank of the nock assembly 106.

An O-ring 112 is disposed within a groove 116 defined in the nock receiver. The O-ring 112 is preferably a plastic or resilient rubber material that can be compressed or deformed upon application of pressure but return to its original shape when the pressure is withdrawn.

A stop tab 114 is generally C-shaped and can be removably disposed in a small gap existing between the forward shoulder of the nock end 106 and the rear surface of the receiver 108 when the battery/LED 110 is in the OFF state. This gap is referred to as an activation gap and will be discussed in further detail later in this description.

The bushing 104 can be formed of aluminum, rigid plastic or other suitable material. The nock end 106 and receiver can be formed of a rigid plastic. The nock receiver 108 can also be formed of aluminum or other suitable material.

Figure 3:
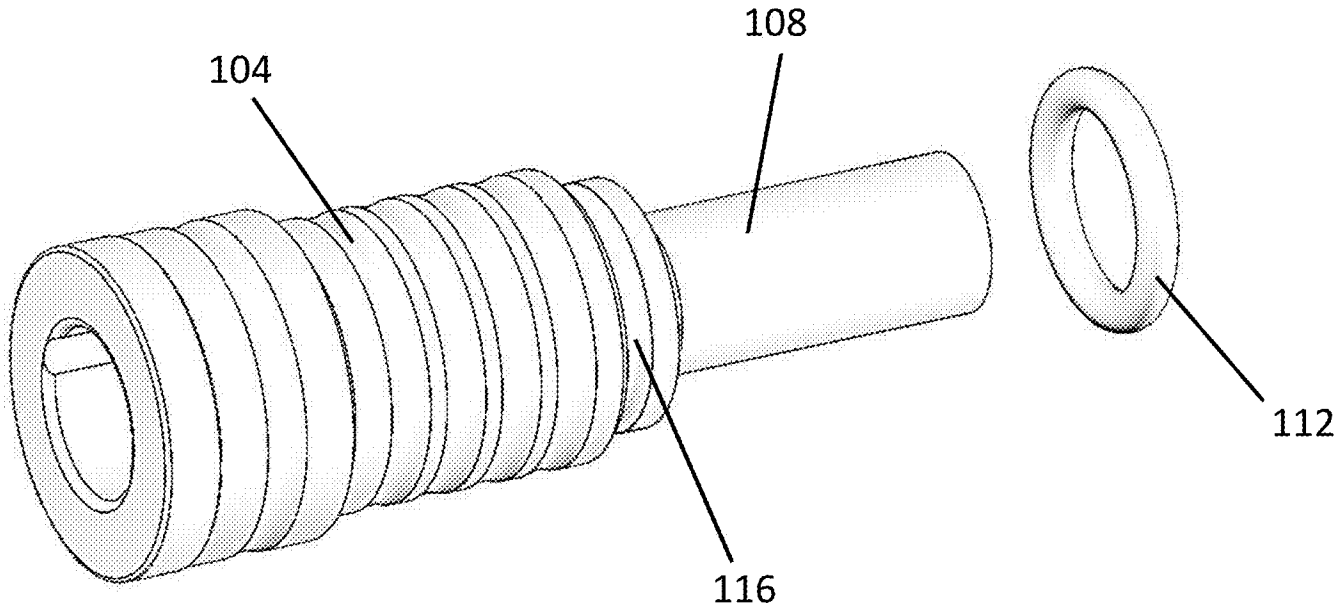
FIG. 3 is a perspective assembly view of a portion of a lighted nock system according to certain embodiments.
Figure 4:
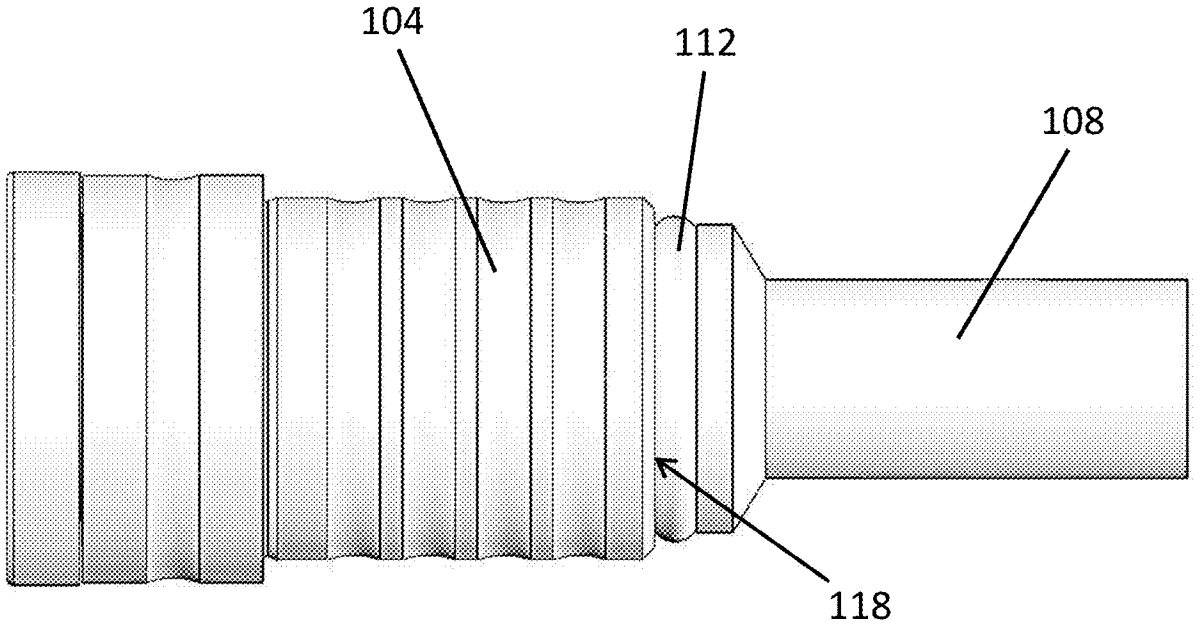
FIG. 4 is a side view of a portion of lighted nock system according to certain embodiments.

Referring to FIGS. 3-4, the bushing 104 and receiver 108 (also referred to as a nock shank or a battery stop) are shown in greater detail. In FIG. 3, the O-ring 112 is shown separated from the groove 116 defined in the receiver 108 where the O-ring 112 will be received. FIG. 4 shows the O-ring 112 in its operational location. Note that it can be seen in FIG. 4 that the O-ring 112 has an outer diameter that is greater than the inner diameter of the bushing 104 and greater than the outer diameter of the receiver 108 portion that inserts into the bushing 104. This relative size of diameters allows the O-ring 112 to abut against a proximal shoulder surface 118 of the bushing 104 when the receiver 108 is inserted through the bushing so that the receiver 108 cannot move rearwardly with respect to the arrow shaft (proximally away from the bushing 104) without the application of a force large enough to deform or compress the O-ring 112 inwards to allow the receiver 108 to be withdrawn through the bushing 104 in the proximal direction (direction opposite the insertion direction).

Figure 5:
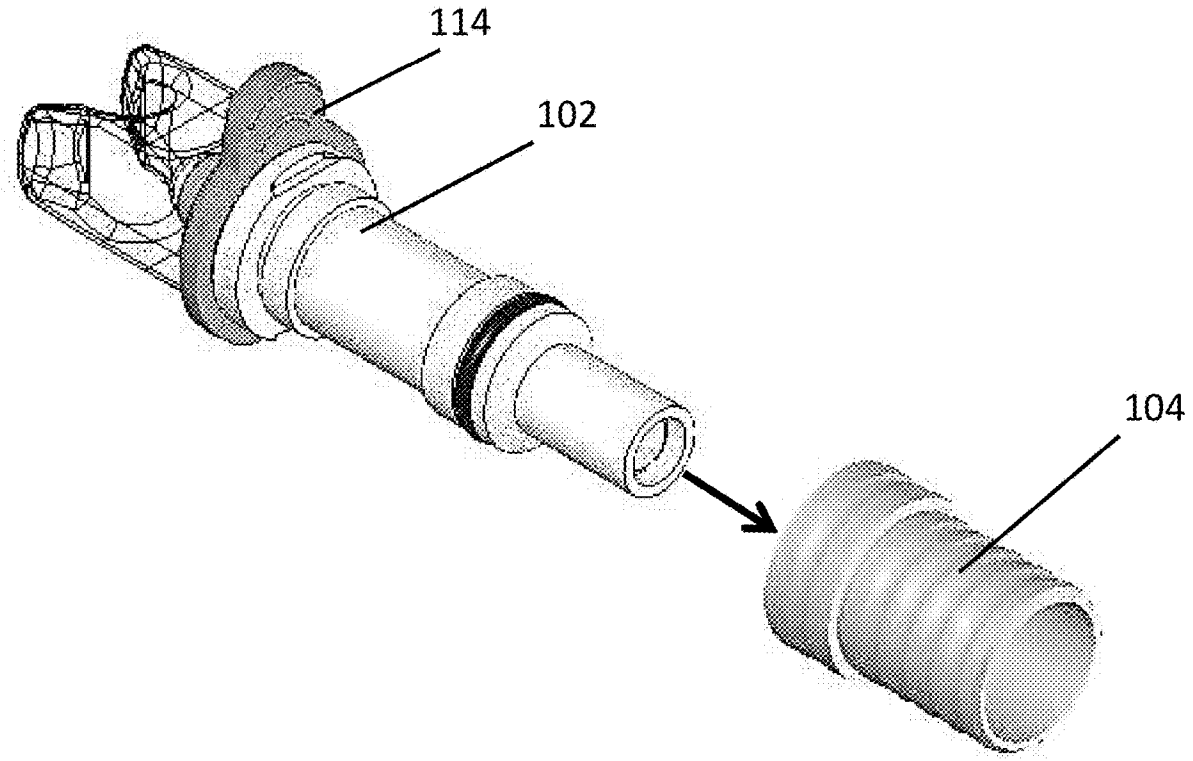
FIG. 5 is a perspective assembly view of a lighted nock system according to certain embodiments.

FIG. 5 shows the assembled nock assembly 102 aligned with the bushing 104. The nock assembly 102 is inserted in the distal direction as indicated by the arrow in FIG. 5 to secure the nock assembly 102 within the bushing 104. Note that the bushing 104 would have already been secured within the arrow shaft.

The bushing 104 is intended to remain permanently within the arrow shaft or crossbow or bolt, while the nock assembly 102 is removable by the user. The bushing 104 can be glued or otherwise securely disposed within the hollow rear end of the arrow shaft or crossbow bolt with glue, an interference fit, mechanical fastening or a combination thereof. The outer diameter of the portion of the bushing that will be inserted into the shaft can be ribbed, grooved or have other texturing to grip the inner surface of the shaft or to hold glue. A portion of the bushing can remain external to the shaft and is then provided with a larger outer diameter that is approximately the same as the outer diameter of the arrow shaft/bolt. This configuration of bushing 104 is illustrated in FIG. 6.

Some of the drawings show a stop tab 114. This is a removable clip or tab that can be used during storage, transport or in the packaging to keep the activation gap 120 from closing so that the LED does not unintentionally turn on and waste the battery power.

Figure 6:
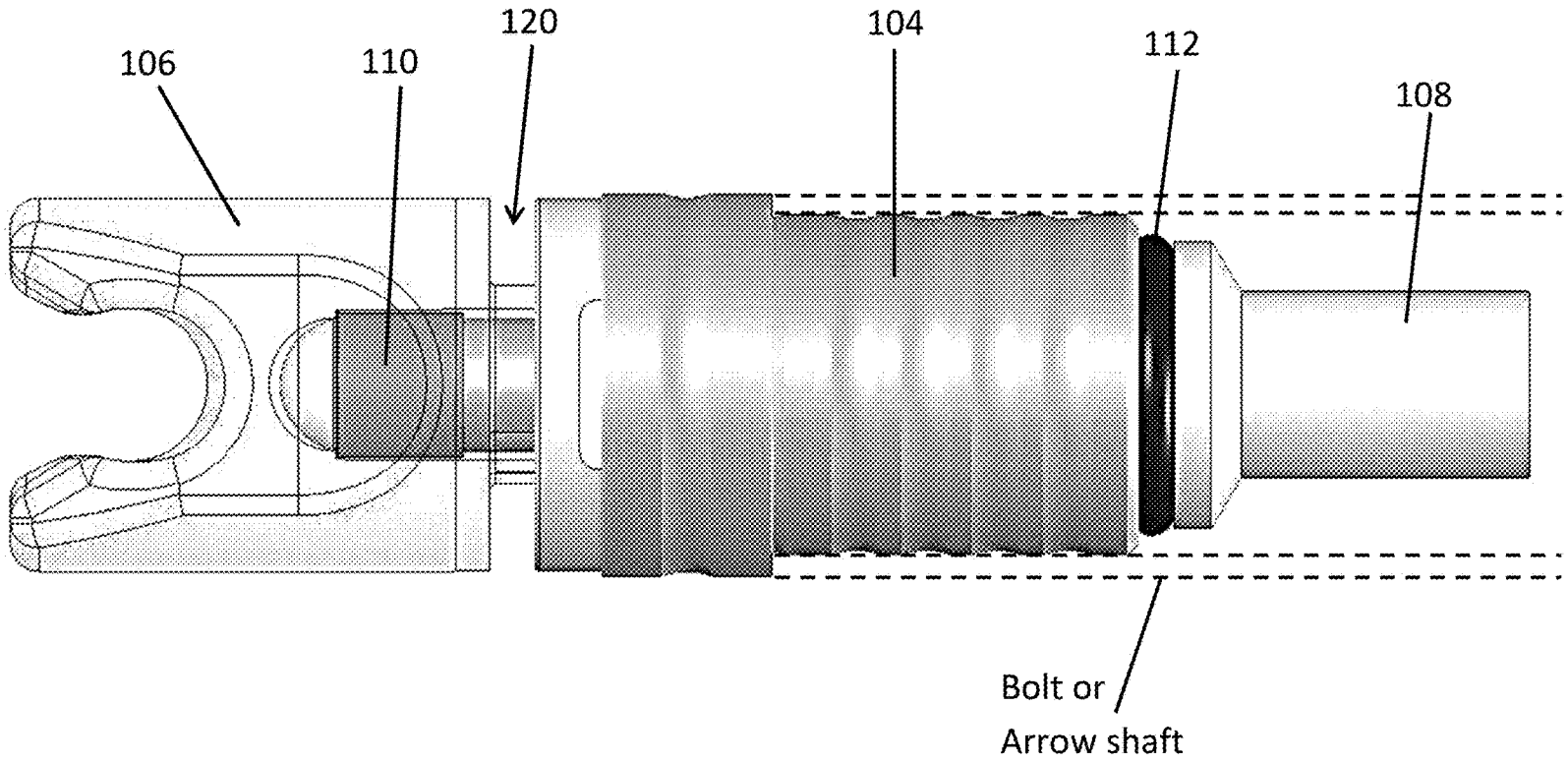
FIG. 6 is a side view of a lighted nock system according to certain embodiments.
Figure 7:
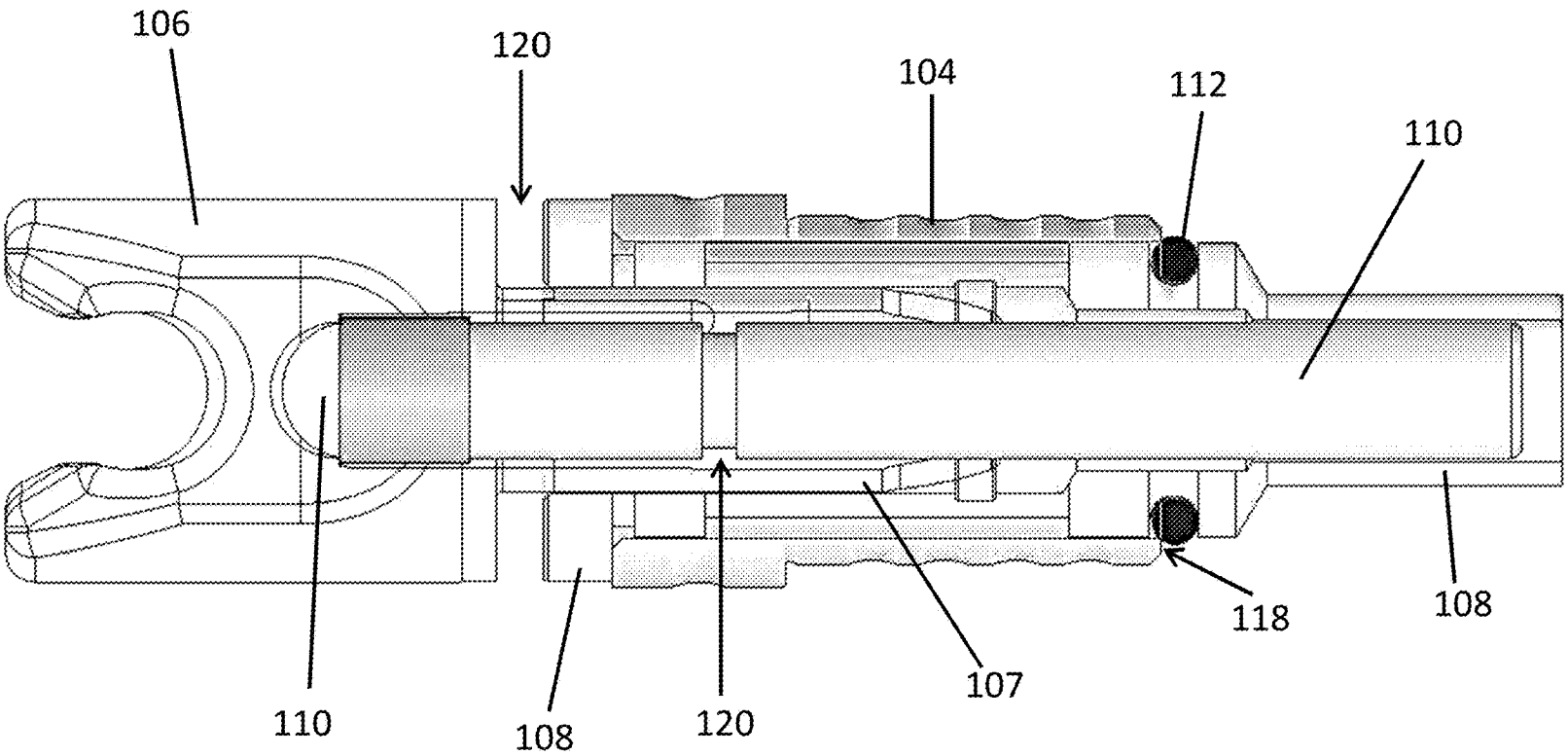
FIG. 7 is a side cross-sectional view of a lighted nock system according to certain embodiments.
Figure 8:
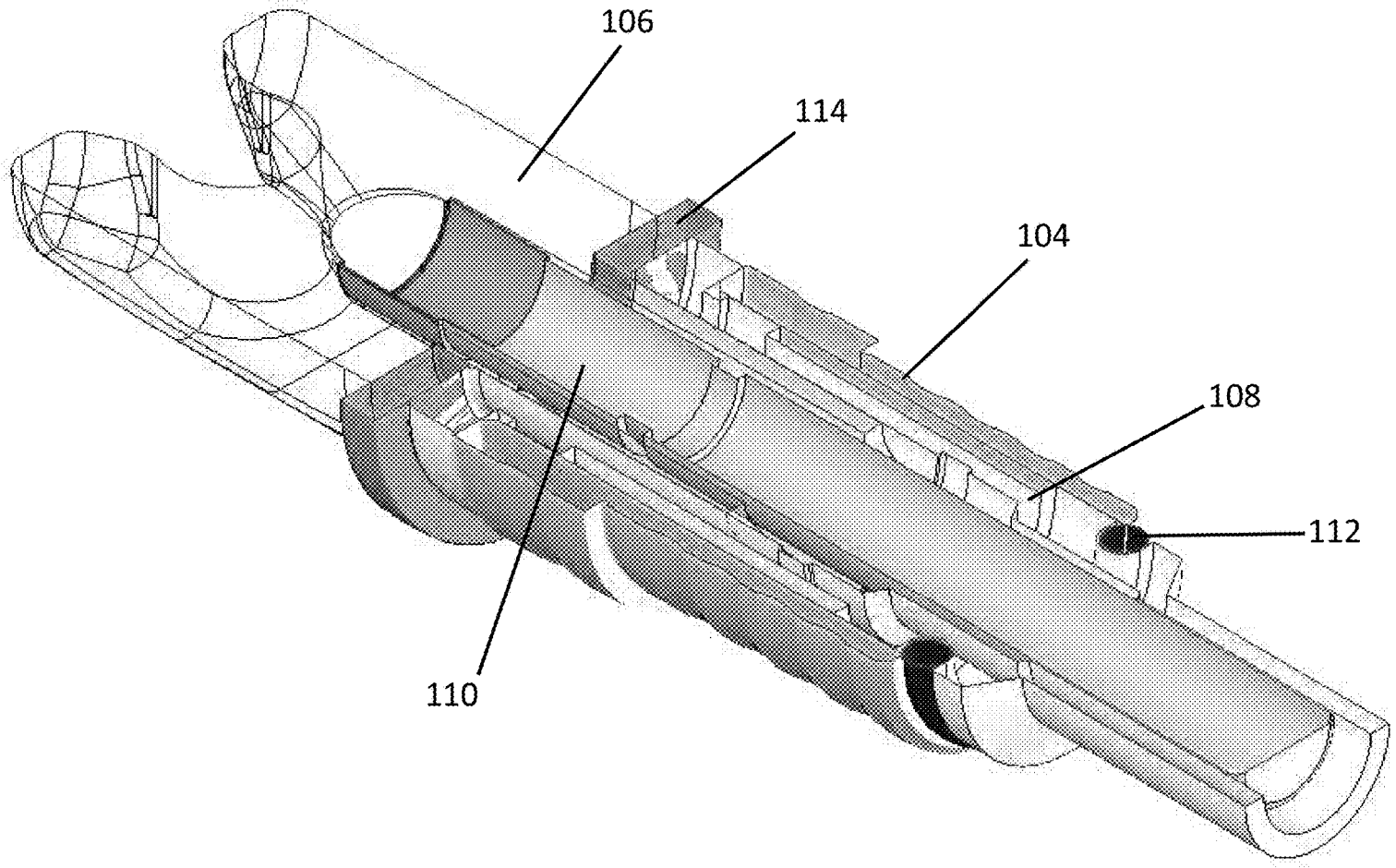
FIG. 8 is a perspective cross-sectional view of a lighted nock system according to certain embodiments.
Figure 9:
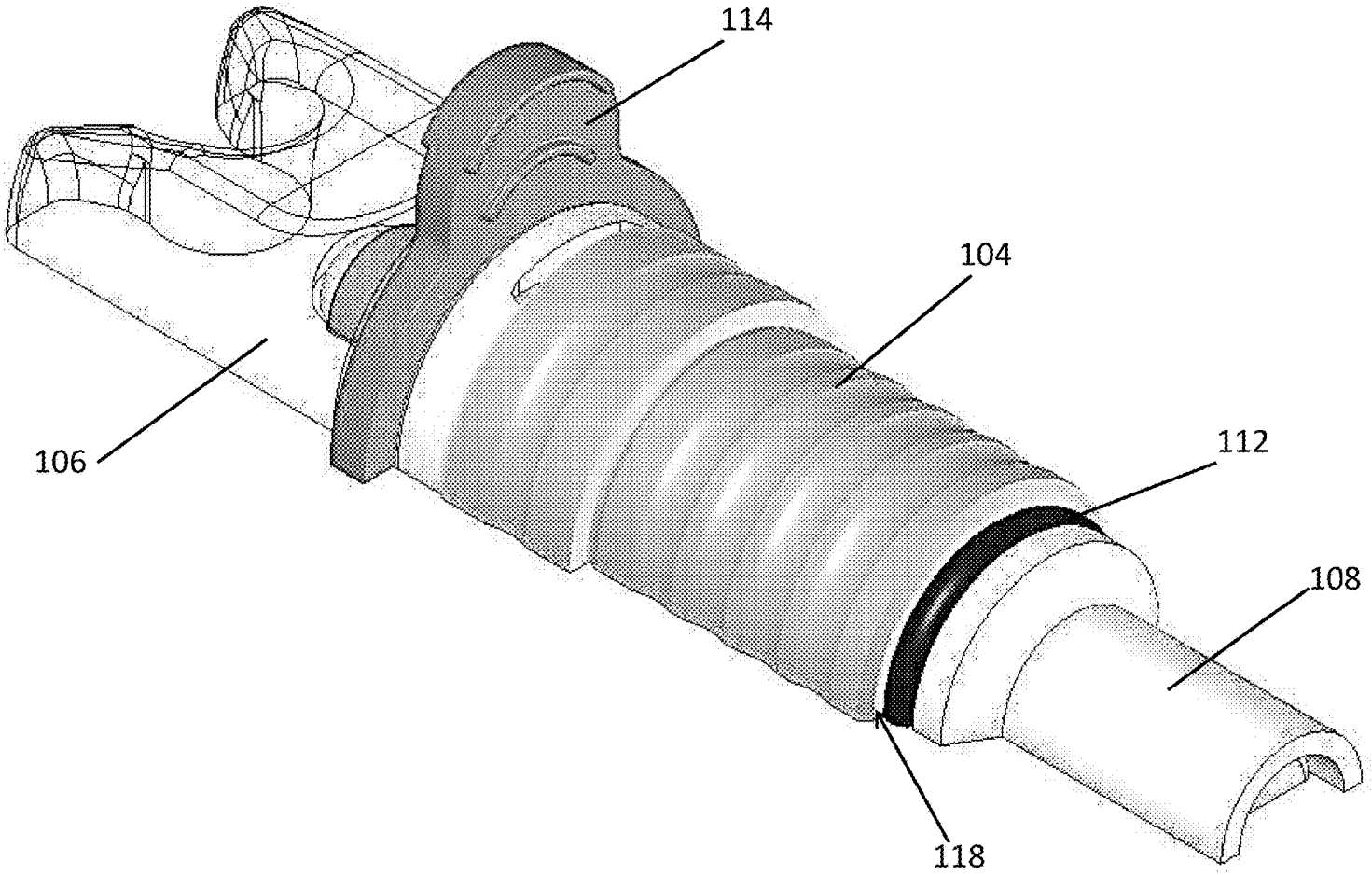
FIG. 9 is a perspective partial view of a lighted nock system according to certain embodiments.

FIG. 6 shows a side view of the assembled lighted nock system 100 disposed in the hollow rear end of a crossbow bolt or arrow shaft. The arrow/bolt is shown in dashed lines for reference. FIG. 7 shows a side cross-sectional view of the lighted nock system shown in FIG. 6. FIG. 8 is another cross-sectional view, but through the horizontal plane and in a perspective view. FIG. 9 is the opposite side of the cross section of FIG. 8 showing the outer side of the nock assembly.

Figure 10:
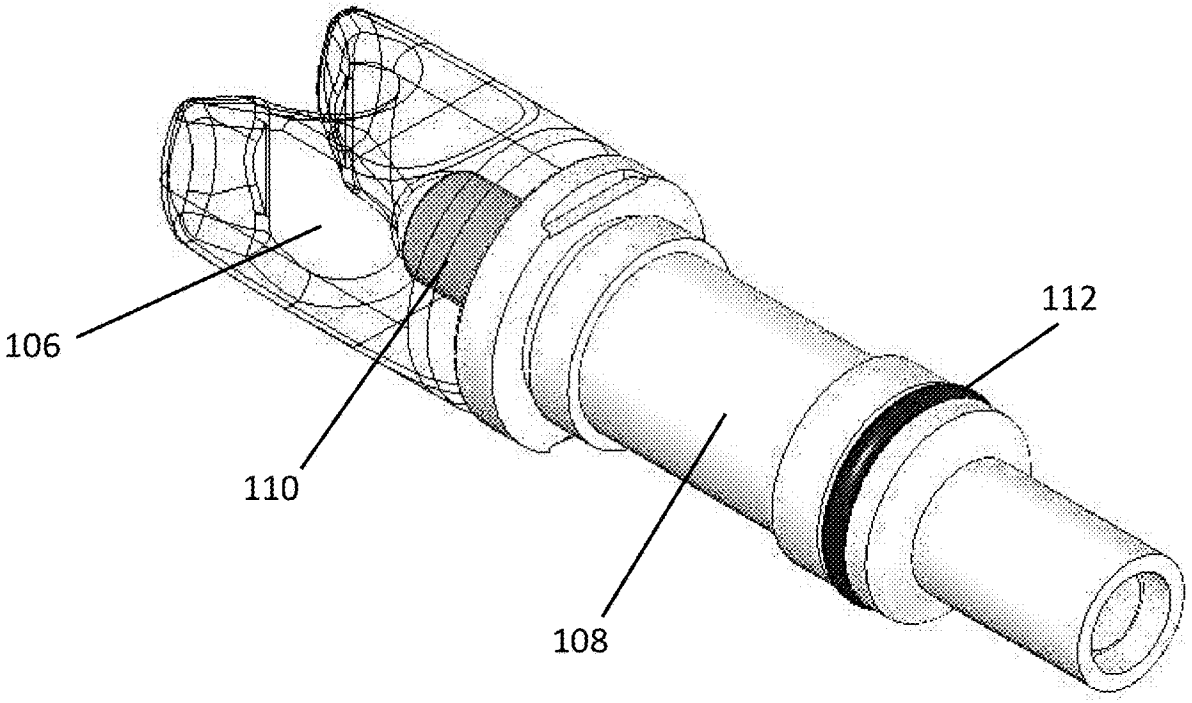
FIG. 10 is a perspective assembly view of a lighted nock assembly according to certain embodiments.
Figure 11:
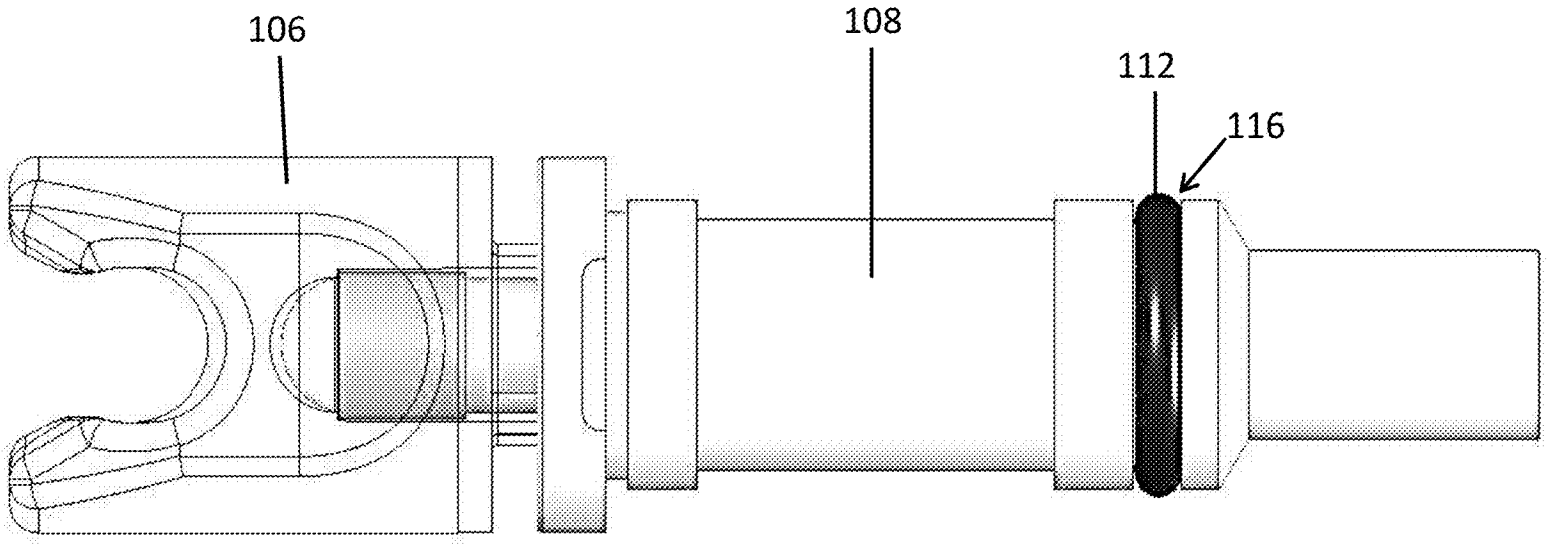
FIG. 11 is a side view of a lighted nock assembly according to certain embodiments.
Figure 12:
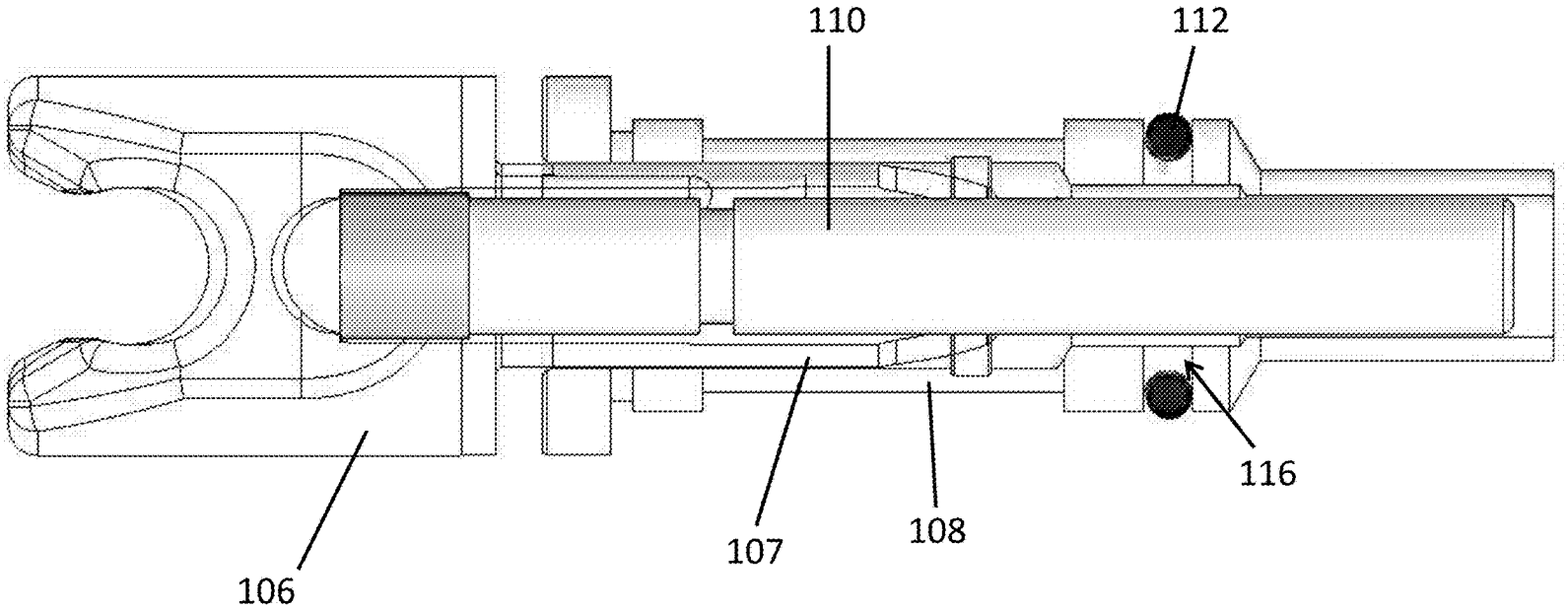
FIG. 12 is a side cross-sectional view of a lighted nock assembly according to certain embodiments.
Figure 13:
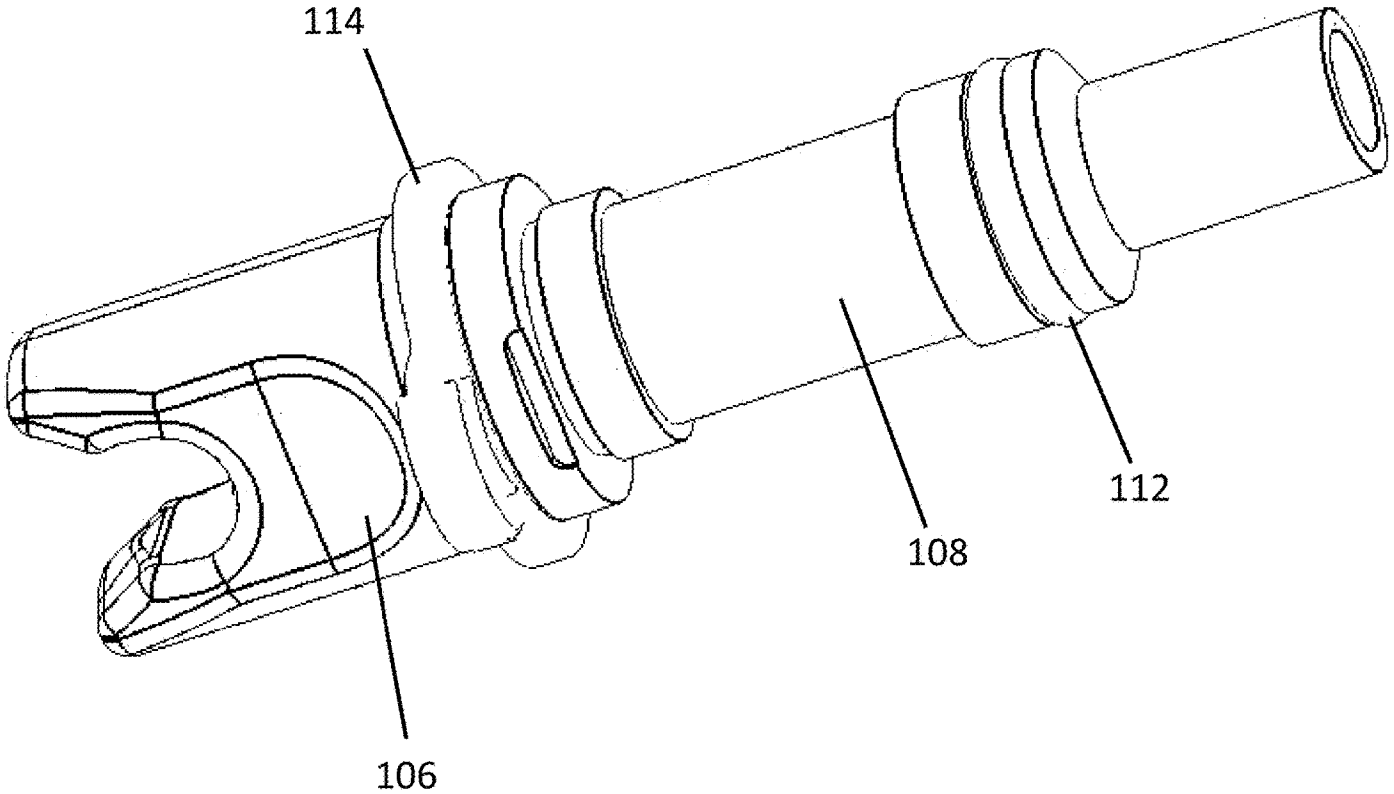
FIG. 13 is a perspective view of a lighted nock assembly according to certain embodiments.
Figure 14:
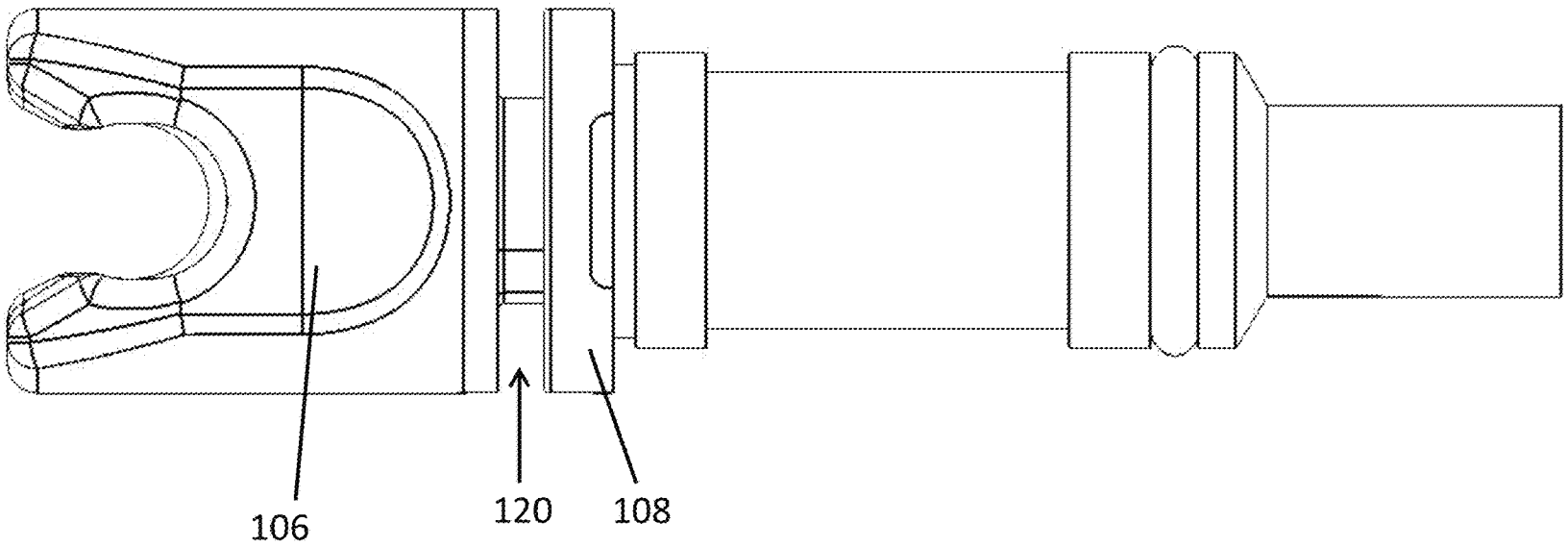
FIG. 14 is a side view of a lighted nock assembly according to certain embodiments.

FIGS. 10-14 show the assembled nock assembly 102 in various views. In particular, FIG. 10 shows the nock assembly in a perspective view, FIG. 11 shows the nock assembly in a perspective view, FIG. 12 shows the nock assembly in a side cross-sectional view taken through a vertical plane across the longitudinal length of the assembly, FIG. 13 shows another perspective view, but now including the stop tab 114, and FIG. 14 shows another side view to highlight the activation gap where the stop tab 114 in FIG. 13 would be located.

The nock end 106 is shown in FIGS. 10-12 to be translucent so that the LED portion of the battery/LED assembly 110 is visible. The nock end 106 in FIGS. 13-14 is more opaque, but will still transmit sufficient light to illuminate when the LED is turned on.

In side views such as FIGS. 11, 12 and 14, it is shown that the normal outer diameter of the O-ring 112 is larger than the outer diameter of the receiver 108 that fits into the bushing. The normal outer diameter of the O-ring 112 would also be selected to be slightly larger than the inner diameter of the bushing 104.

Figure 15:
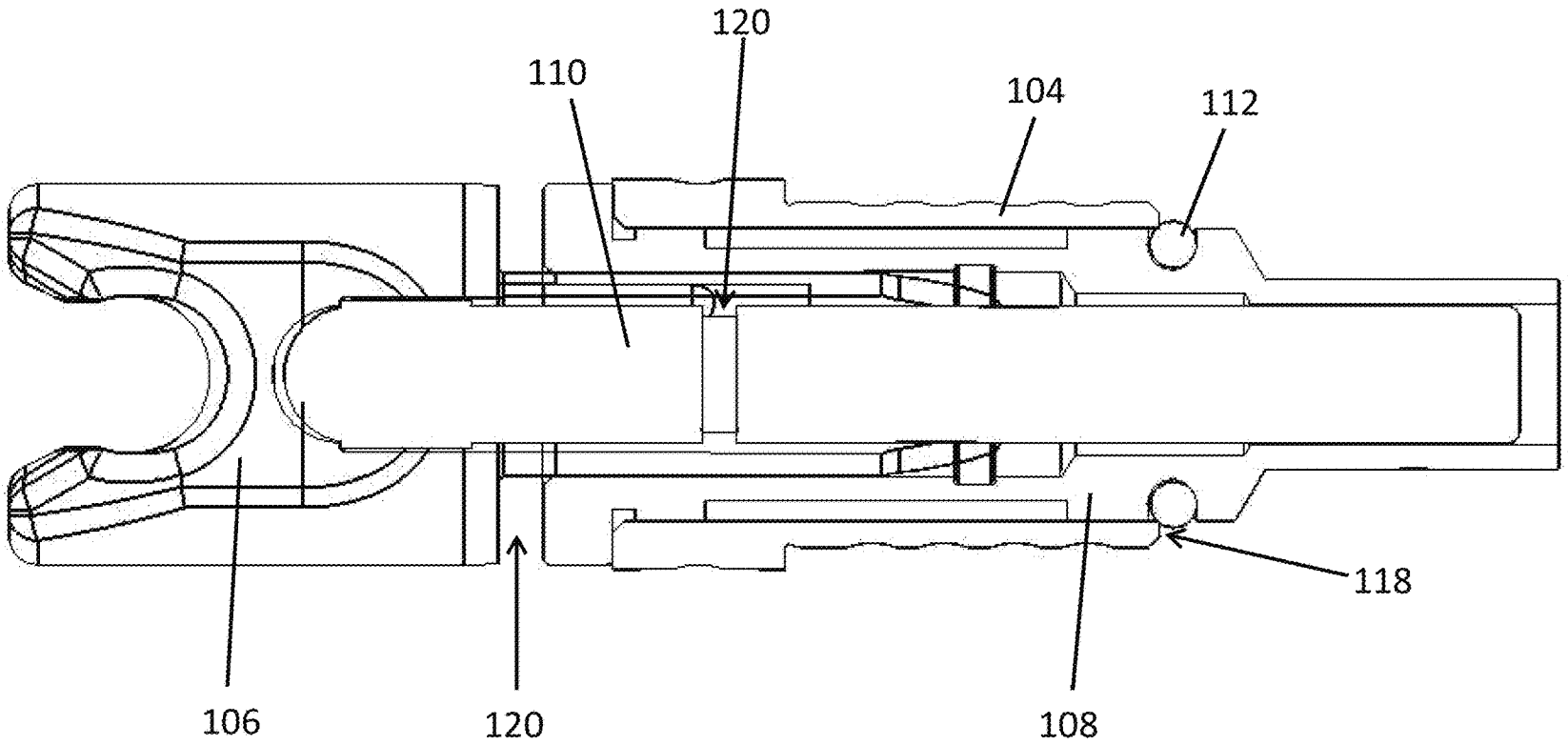
FIG. 15 is a side cross-sectional view of a lighted nock assembly according to certain embodiments.
Figure 16:
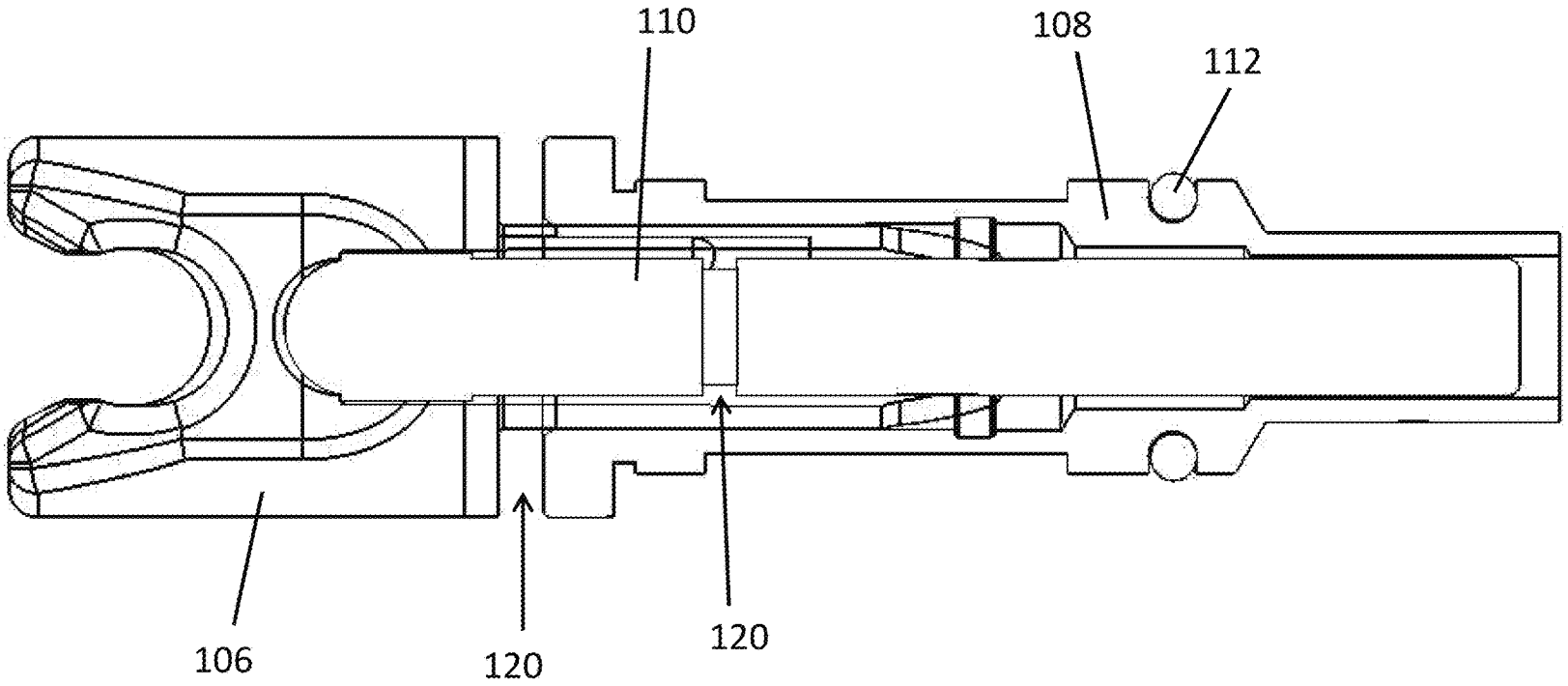
FIG. 16 is another side cross-sectional view of a lighted nock assembly according to certain embodiments.
Figures 17A, 17B:
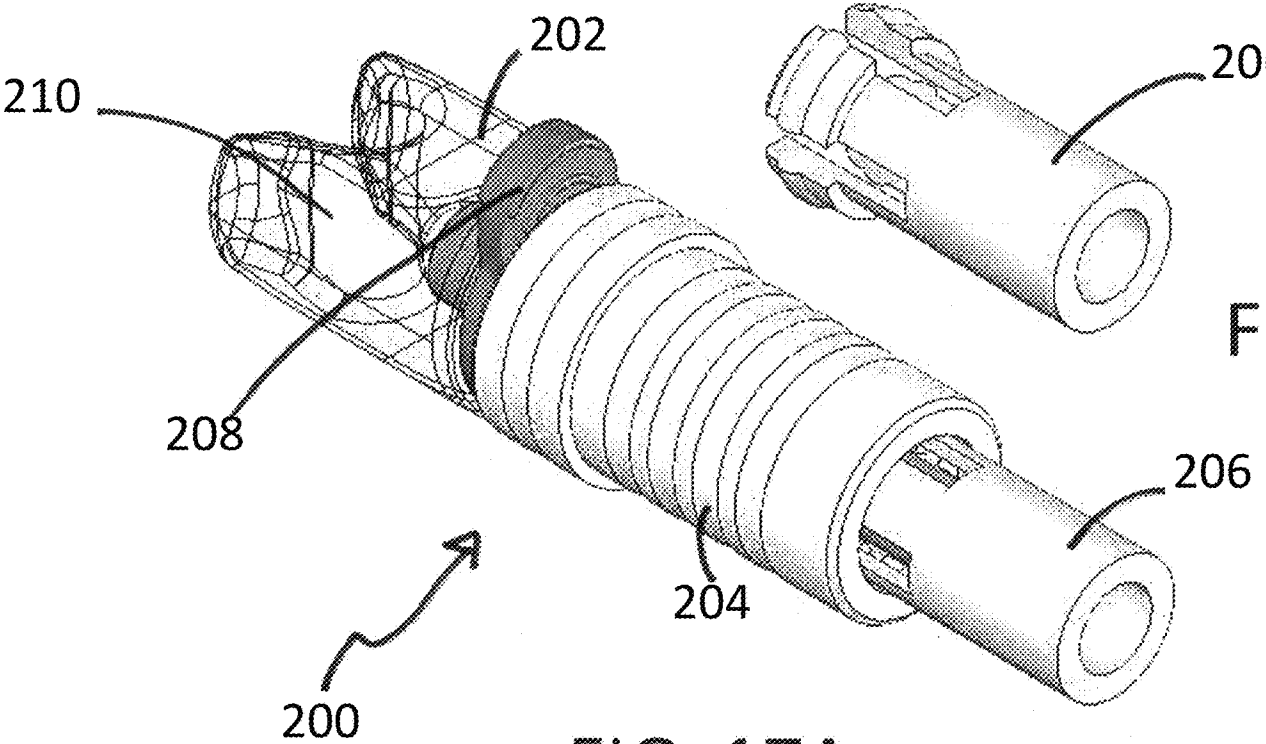
FIG. 17A is a perspective view of an archery nock system according to certain embodiments.
FIG. 17B is a perspective view of a battery stop of an archery nock system according to certain embodiments.
Figures 18A, 18B:
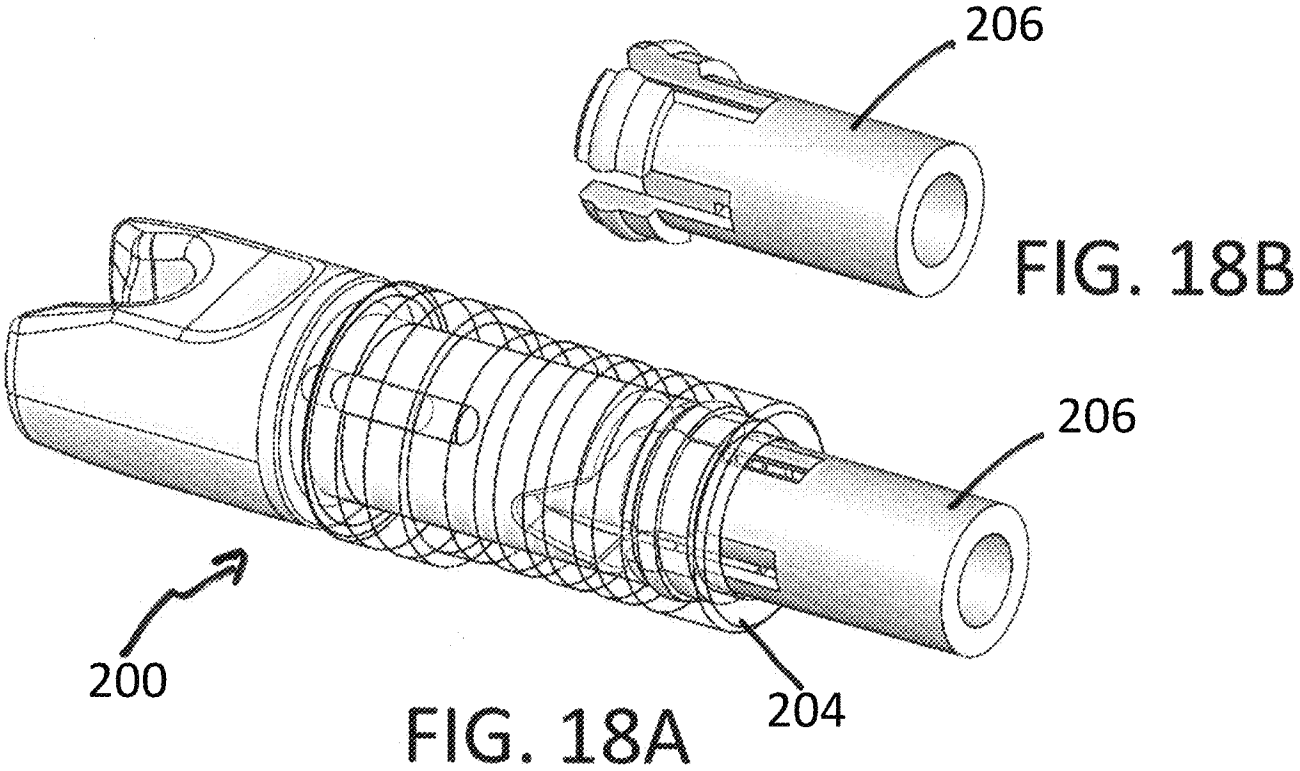
FIG. 18A is a perspective view of an archery nock system according to certain embodiments.
FIG. 18B is a perspective view of a battery stop of an archery nock system according to certain embodiments.
Figure 20:
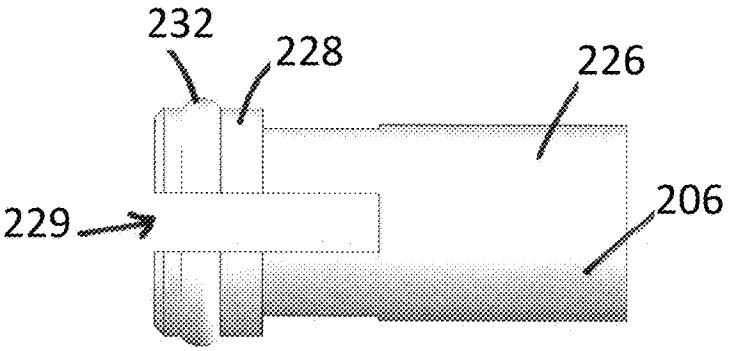
FIG. 20 is a side view of a battery stop of an archery nock system according to certain embodiments.
Figure 22:
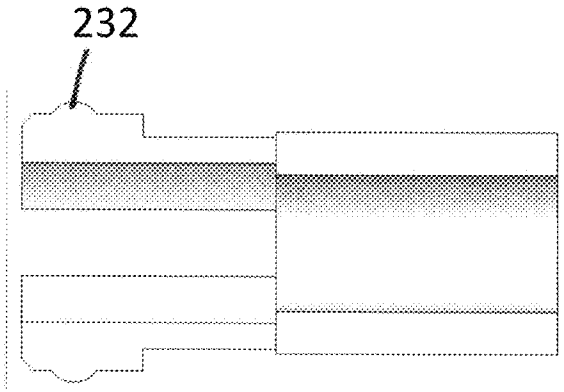
FIG. 22 is a side-cross-sectional view of a battery stop of an archery nock system according to certain embodiments.
Figure 19:
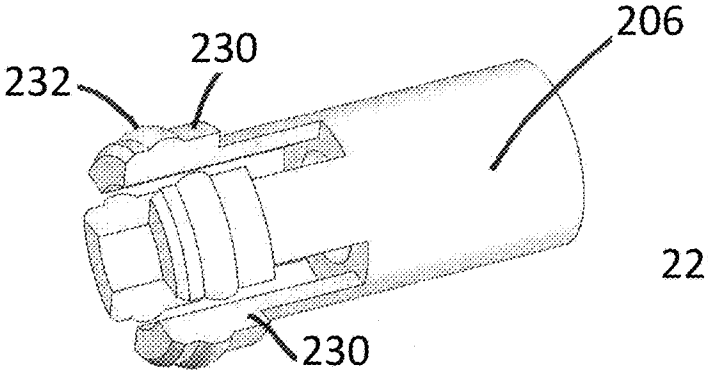
FIG. 19 is a perspective view of a battery stop of an archery nock system according to certain embodiments.
Figure 21:
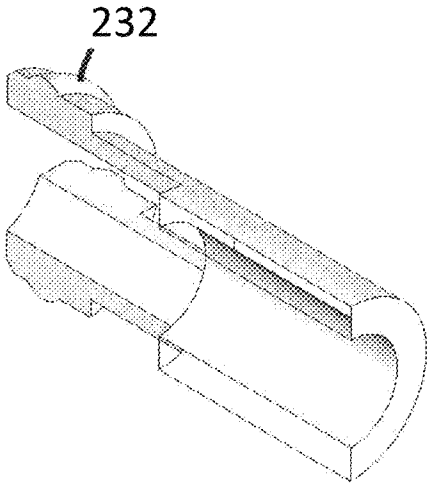
FIG. 21 is a perspective cross-sectional view of a battery stop of an archery nock system according to certain embodiments.

Referring to FIG. 15 the depicted cross-sectional side view of the lighted nock assembly 102 engaged with the bushing 104 illustrates that the O-ring 112 engages a shoulder 118 or other edge of the bushing 114 to prevent the nock assembly 102 from moving rearwardly (proximally) with respect to the arrow/bolt. FIG. 16 is similar to FIG. 15 except the bushing 104 is not depicted in FIG. 16.

The activation gaps 120 in the battery/LED component 110 and between the nock end 106 and housing 108 are indicated in FIGS. 15-16 among others. Since the LED portion of the battery/LED component is secured in the nock end 106 and the opposing battery portion is secured in the housing 108, there is formed a gap between the nock 106 and housing 108 corresponding to the gap between the LED portion and the battery portion of the battery/LED component 110. This permits the nock to be moved toward the housing (distal direction) in order to close the activation gap 120 and turn on the LED. The LED can be deactivated by pulling the nock the opposite direction (proximally) away from the housing.

It is preferable that the force required to pull the nock end rearwardly to turn off the LED is less than the force required to deform the O-ring 112 and pull the lighted nock assembly out of the bushing. The force required for the latter can be adjusted via the properties of the O-ring employed and/or the degree of difference between the O-ring outer diameter and the inner diameter of the bushing 104.

The lighted nock system 100 can be packaged and sold in combination with an arrow or bolt. The nock assembly 102 and/or the bushing 104 can be pre-assembled in such situation.

In another example, the bushing can be installed into the shaft/bolt prior to packaging for sale. The nock assembly 102 that fits the pre-installed bushing can then be sold separately.

The present lighted nock assembly can be packaged with one or more adaptors or different outer diameter sized bushings in a single package as disclosed in U.S. Pat. No. 8,777,786 in order to provide a universal fit retail package or kit.

Additional replacement O-rings can be included in the same package as the lighted nock system. The additional O-rings can also have different stiffness or durometer values so that the user can adjust the amount of force required to pull the nock assembly distally out of the bushing. The O-rings can also come in a variety of colors so that different nock assemblies can be readily differentiated.

Male registration features such as the raised tabs disclosed in the incorporated U.S. Pat. No. 8,777,786 can be defined on the nock shank 107 with female recesses defined in the inner surface of the receiver 108 to prevent the nock end 106 from rotating relative to the receiver 108 (or vice-versa). The straight proximal-distal movement of the nock end 106 to turn the LED ON and OFF can thus be performed without the risk of altering the rotational alignment of the nock end.

Male registration features such as the raised tabs disclosed in the incorporated U.S. Pat. No. 8,777,786 can also be defined on the outer surface of the receiver 108 with female recesses defined in the inner surface of the bushing 104 to prevent the nock assembly 102 from rotating relative to the bushing 104. Thus, the user can easily remove and reinsert the nock assembly 102 (or a new replacement nock assembly) while maintaining the original axial rotational alignment of the nock end 106 with respect to the arrow shaft.

The male tabs and female recesses in the foregoing embodiments can be reversed in alternative embodiments. Only one registration feature need be provided. Alternatively, two or more registration features can be provided. The registration features will be discussed in further detail in the following embodiments, but such features can be provided to any of the foregoing embodiments as well.

Referring now to FIGS. 17A-18B, a nock system 200 according to a further embodiment generally comprises a hollow bushing 204 that is secured within the hollow rear (proximal) end of the arrow shaft or bolt and a nock assembly 202 that fits into the inner diameter of the bushing 204.

The bushing 204 can be secured in the shaft with glue, interference frictional fit or other suitable means. The bushing 204 is intended to remain secured within the end of the shaft/bolt and not be removed. The bushing 204 can be secured within the arrow/bolt shaft as part of the bolt/arrow shaft manufacturing process or by a user.

The nock assembly 202 generally comprises a nock end 210 and a battery stop 206 with a battery/LED assembly 212 or a non-lightable roll pin 214 disposed therebetween. This is illustrated in further detail in FIGS. 32-35.

Figure 25:
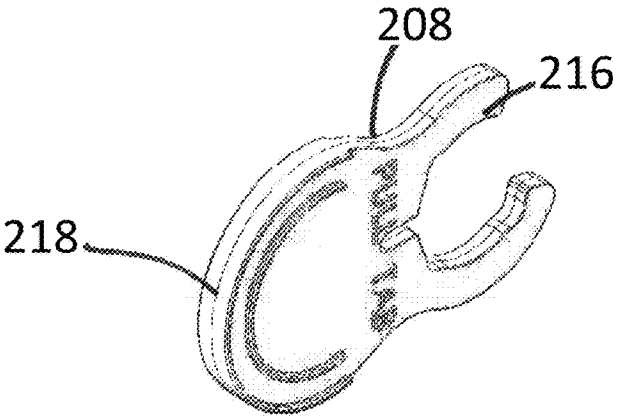
FIG. 25 is a perspective view of a stop tab of an archery nock system according to certain embodiments.
Figure 26:
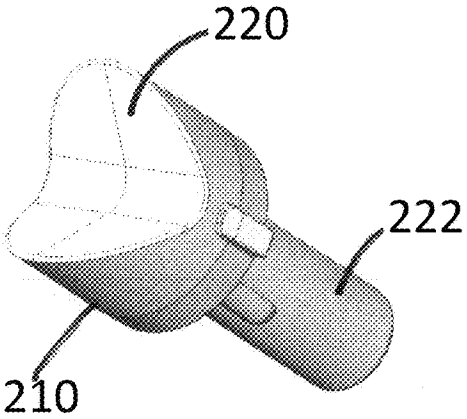
FIG. 26 is a perspective view of a nock end of an archery nock system according to certain embodiments.
Figure 27:
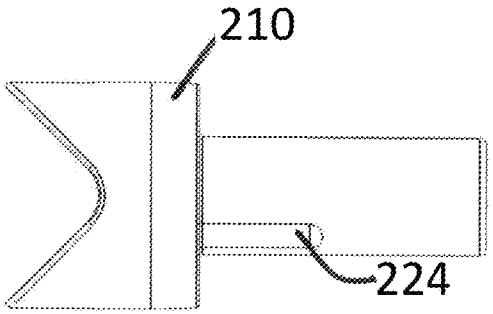
FIG. 27 is a side view of a nock end of an archery nock system according to certain embodiments.
Figure 28:
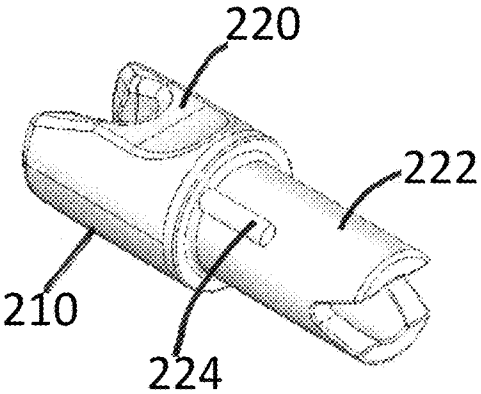
FIG. 28 is a perspective view of a nock end of an archery nock system according to certain embodiments.
Figure 30:
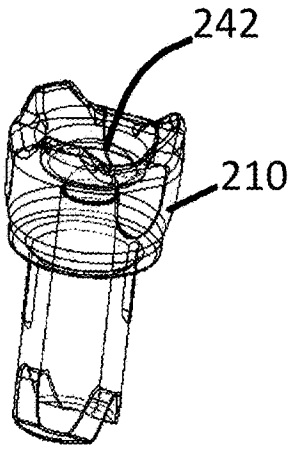
FIGS. 29, 30 and 31 are perspective views of a nock end of an archery nock system according to certain embodiments, with FIGS. 30-31 showing hidden internal details.
Figure 29:
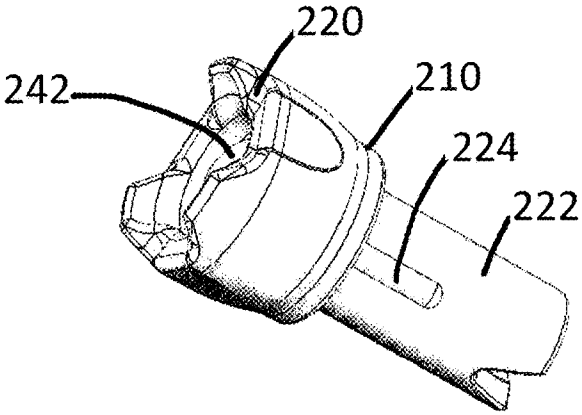
Figure 31:
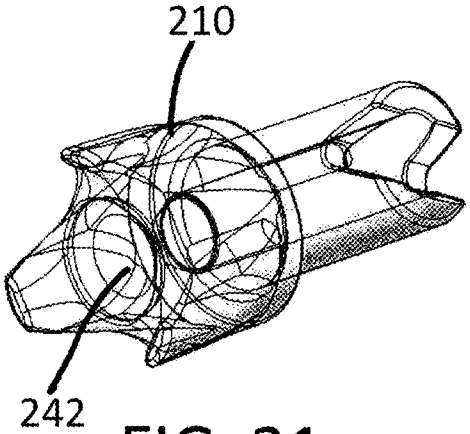

A removable stop tab 208 can be disposed in the activation gap between the nock end 208 and the proximal end of the bushing 204. Referring additionally to FIG. 25, the stop tab 208 defines an approximate C-shape body 216 to fit around the outer diameter of the distal shank of the nock end 208. A flange portion 218 is defined opposite the C-shaped portion 216. The flange is generally flat but can have raised lettering or other relief to aid in grip with the user's fingers. The flange can be made relatively large to prevent accidental loading of a crossbow bolt with the stop tab 208 still in place. The stop tab 208 must be removed before shooting the bolt or arrow.

Referring to FIGS. 26-35, the nock end 210 defines a proximal string engaging portion 220 defining a proximal surface that is configured to engage the string of the bow/crossbow and a distal shank portion 222 that inserts into the bushing 204. The shank 222 is hollow with the distal end open. This open end allows the LED and a portion of the battery to be inserted into the hollow interior of the nock end 210 where the LED portion is secured inside of the nock end, e.g. with glue. The hollow interior of the nock end 210 extends from the distal shank end inward proximally towards the proximal surface that engages the string, but does not extend all the way through the nock end as can be seen in the figures.

The string engaging portion 220 can take any desired shape. For example, FIGS. 26-27 define a half-moon shape, FIGS. 28, 32 and 33 define a capture-style nock and FIGS. 29-31 define a TALON® style nock (By Easton). Other string engaging end configurations such as the OMNI style (TenPoint) and a planar or flat back style, or any other desired style of string engaging portion 220 configuration can be provided without departing from the scope of the invention.

Figure 24:
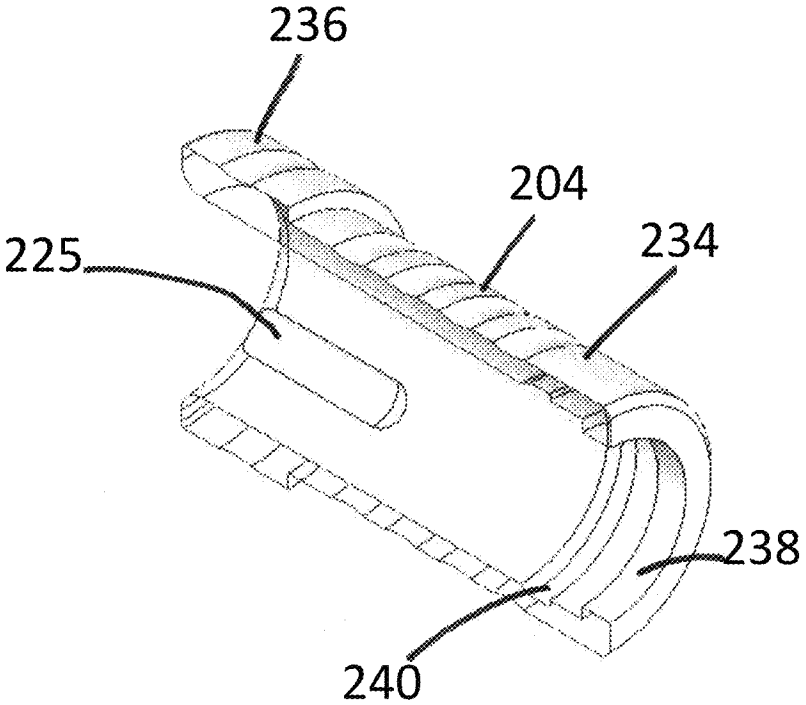
FIG. 24 is a perspective cross-sectional view of a bushing of an archery nock system according to certain embodiments.
Figure 23:
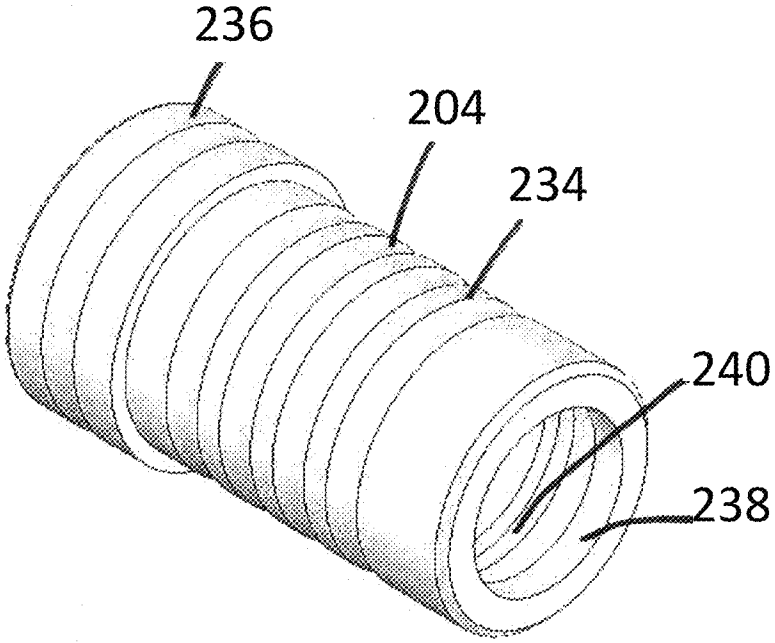
FIG. 23 is a perspective view of a bushing of an archery nock system according to certain embodiments.

The shank portion 222 has an outer diameter selected to just barely clear the inner diameter of the bushing 204. An indexing feature in the form of a raised rib 224 extends longitudinally along the shank and engages a corresponding recess 225 defined within the bushing inner wall (FIG. 24) to prevent the nock end 210 from rotating with respect to the bushing 204 when the nock end is moved longitudinally towards and away from the bushing 204 to turn the LED on and off. The rib shown is cylindrical, but other shapes can be provided, such as triangular, polygonal and complex. Just one rib/recess can be provided, or a plurality of ribs/recesses can be provided. In multiple rib/recess embodiments, each rib/recess pair can be differently proportioned and/or shaped so that the nock can only be installed in one possible orientation.

The registration feature(s) ensures that the nock end 210 and nock assembly 202 will always have the same axial orientation with respect to the arrow shaft or crossbow bolt even if the nock assembly 202 is removed and replaced and further during the on/off movement of the nock end. Thus, the user can easily remove and reinsert the nock assembly 202 (or a new replacement assembly) while maintaining the original alignment of the nock end 210 and nock assembly 202 with the arrow shaft/bolt.

Details of the battery stop 206 will not be described with particular reference to FIGS. 17B, 18B, 19-22, 32-35. The battery stop 206 defines a cylindrical distal shank portion 226 and a proximal head portion 228. The shank portion 226 has an outer diameter sized to just fit through the distal aperture of the bushing 204, while the head portion 228 has a larger outer diameter than the shank portion 226. The battery stop 206 is hollow through its entire length. However, the distal end could be closed in alternative embodiments. The hollow center defines a cylindrical cavity with sufficiently large inside diameter to receive a distal end segment of the battery portion of the battery/LED component. The segment of the battery that is received within the shank portion is secured to the shank portion via glue or other suitable means.

The head portion 228 of the battery stop 206 is slotted via two or more slots 229 defined into the sidewall from the proximal end and extending through the head portion and partially into the shank portion. The inside diameter of the slotted portion is larger than the non-slotted portion so that the resilient finger members 230 defined between the slots are able to flex inwardly when the battery is secured within the shank portion.

The outer surface of the finger portions 230 defines a raised circumferential rib portion 232. The ribs 232 together define a larger effective outer diameter than the head 228 or the shank 226 outer diameters. Also, the ribs 232 together define a larger outer diameter than the inner diameter of the bushing 204. This configuration causes the battery stop 206 to secure into the bushing 204 when the ribs land within the respective groove 240 defined into the inner cylindrical surface of the bushing 204. The fingers 230 initially deflect inward during the insertion process and spring outward once the groove 240 is reached.

Also, the head portion 228 has a larger outer diameter than the distal aperture 238 diameter of the bushing 204 so that the user cannot push the battery stop 206 past the distal aperture 238 of the bushing 204.

The number of finger portions can be varied. A four-fingered embodiment is depicted, but as few as two fingers can be provided, three fingers can be provided, and more than four fingers can be provided in other embodiments.

Details of the bushing 204 can be seen in FIGS. 17A, 18A, 23-24 and 34-35. The bushing 204 is generally a hollow cylinder that defines a distal shank portion 234 and a proximal head portion 236. The outer surface of the shank portion 234 can be ribbed, knurled or otherwise textured to better grip the inside surface of the arrow shaft or crossbow bolt. The bushing 204 can be secured into the arrow shaft/bolt via interference fit, via glue, or other means, or combination thereof. Regardless of the securing means, the bushing 204 is intended to be permanently installed within the shaft or bolt. More particularly, the shank portion 234 extends into the shaft or bolt while the head portion 236 abuts against the rear or proximal end of the shaft/bolt and protrudes outside of the shaft/bolt. Thus, the head portion 236 has an outer diameter that is larger than the inner diameter of the shaft/bolt so that the head portion 263 cannot enter inside of the shaft. In an additional aspect, the head portion 236 has an outer diameter approximately the same as the outside diameter of the arrow shaft or crossbow bolt.

The hollow inside of the bushing 204 is defined by a cylindrical surface extending from the proximal (head) end to a point adjacent to the distal (shank) end. The diameter narrows at the distal end to define the distal aperture 238 discussed previously.

The circumferential groove 240 is defined into the inner surface of the bushing 204. The groove 240 is sized to engage the corresponding ribs 232 of the battery stop.

The ribs and groove can be swapped positions such that the fingers define recesses therein and the inner surface of the bushing defines a circumferential raised rib.

The retaining force of the ribs 232 in the groove 240 can be varied based upon the material property of the battery stop 206, the length of the slots 229, the size and shape of the groove/recess, or a combination of any of the preceding. As stated previously, it is preferable for the retaining force for the nock assembly in the bushing to be greater than the force required to turn off the LED in order to avoid unintended withdrawal of the nock assembly from the arrow shaft/bolt when the user merely wanted to turn the LED off.

The force required to insert the nock assembly into the bushing can be less than the force required to remove the nock assembly from the bushing. This can be accomplished, for example, by providing a different slope on the proximal and distal sides of the groove 240 and rib 232. For example, a smaller slip for resisting seating the nock assembly can be provided as compared to a relatively steeper slope for resisting removal.

The recess 225 for receiving the registration rib 224 of the nock end 210 is defined longitudinally into the inner surface of the bushing 204 starting at the proximal (head) end 236 and extending to a given distal depth. The depth would be at least the longitudinal length of the rib 224 plus the width of the activation gap 213 of the battery/LED component (FIG. 34), plus any additional desired relief or tolerance to ensure that the on/off action of the LED operates without bottoming out the rib 224 in the recess 225.

Figure 34:
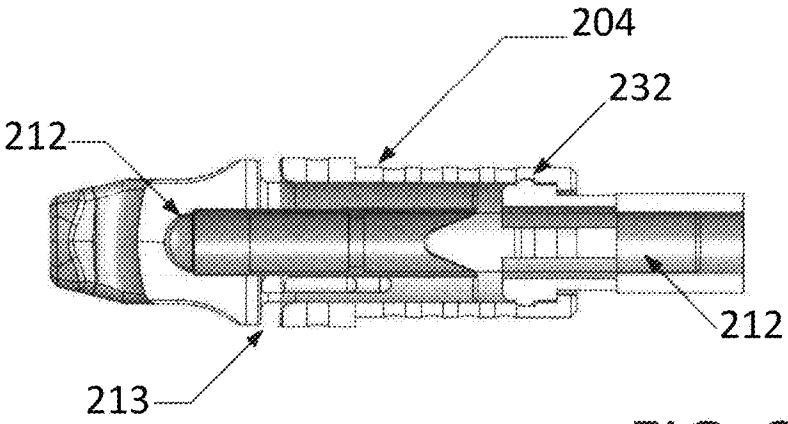
FIG. 34 is a side cross-sectional view of a nock system according to certain embodiments.

As shown in FIG. 34, an activation gap 213 is defined between the nock end and the bushing. The gap 213 is open when the LED of the battery/LED component 212 is deactivated, off or not lighted. The gap 213 is closed by moving the nock end from the position shown in FIG. 34 towards the bushing to close the gap, which activates, turns on, or lights the LED.

Figure 35:
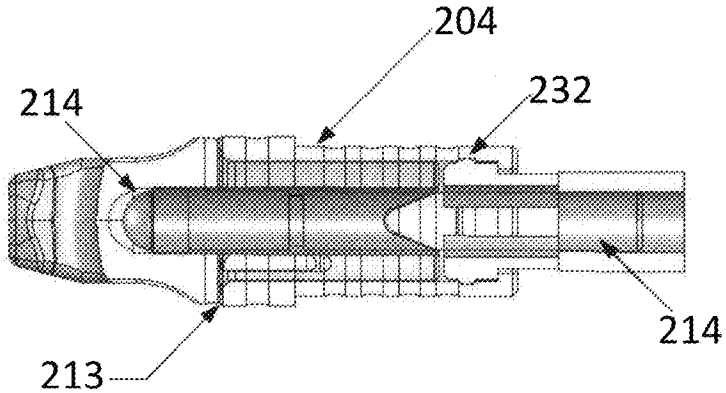
FIG. 35 is a side cross-sectional view of a nock system according to certain embodiments.

In FIG. 35, the battery/LED component has been replaced with a roll pin 214, which is simply a placeholder component to take the place of the battery/LED component in a non-lightable nock assembly. The user can readily swap between lightable and non-lightable versions as desired without altering the performance characteristics of the arrow or bolt because the roll pin is weighted to mimic the battery/LED component.

The nock system 200 can be configured either as a lighted nock or as a non-lighted nock. The non-lighted configuration replaces the battery/LED component 212 with a metal or plastic roll pin 214 or other dummy piece that takes the place of the battery/LED component 212 and maintains the same weight, balance and other performance characteristics as the lighted version. For example, the roll pin 214 can be an elongated round plastic shaft that has an equivalent diameter to equal the weight (e.g. 6 grains) of the battery/LED component 212 in the lighted configuration. Thus, the archer can swap between lighted and non-lighted versions of the nock assembly 202 with confidence that the performance will not change regardless of which version is being used. Moreover, the registration features discussed herein ensure that the rotational alignment of the string engaging portion 220 to the arrow shaft or crossbow bolt will remain the same.

The nock end 210, battery/LED 212 (or roll pin 214) and battery stop are replaceable as an integrated assembly since the nock end 210 and battery stop 206 are typically glued to respective LED and battery portions of the battery/LED or roll pin component. To remove the nock assembly 202, the user can simply grasp the nock end 210 and pull proximally away from the bushing 204 with sufficient force to overcome the retaining force of the resilient fingers engaged with the groove in the bushing.

Insertion is performed in the reverse order, wherein the battery stop is inserted into the bushing and the whole assembly is longitudinally advanced (distally) until the ribs 232 of the resilient fingers 230 engage with the groove 240 in the bushing 204. During this insertion, the user rotates the nock end 210 to ensure that the rib 224 aligns with its respective recess 225. If the alignment is not performed, then the rib 224 will prevent the assembly 202 from fully entering the bushing 204 and the groove 240 of the bushing will not be engaged.

The archer can also replace the lighted nock assembly 202 with another assembly having a different LED color, or simply replace the assembly with another one of the same when the original's battery is drained. The archer can also perform a replacement of the assembly with another that has a different style or shape of string engaging portion 220 of the nock end 210. Thus, it should be clear that the present system allows for easy replacement with other compatible nock assemblies (both lightable and non-lightable) while maintaining consistent performance from one assembly to the next when joined with the arrow/bolt.

In non-lighted assemblies, the nock end 220 can be a solid color since no light need penetrate through the nock end. Also, the roll pin 214 has a length such that the activation gap 213 would not exist as shown in FIG. 34 in order to match the ON configuration of the corresponding lighted nock assembly.

Figure 33:
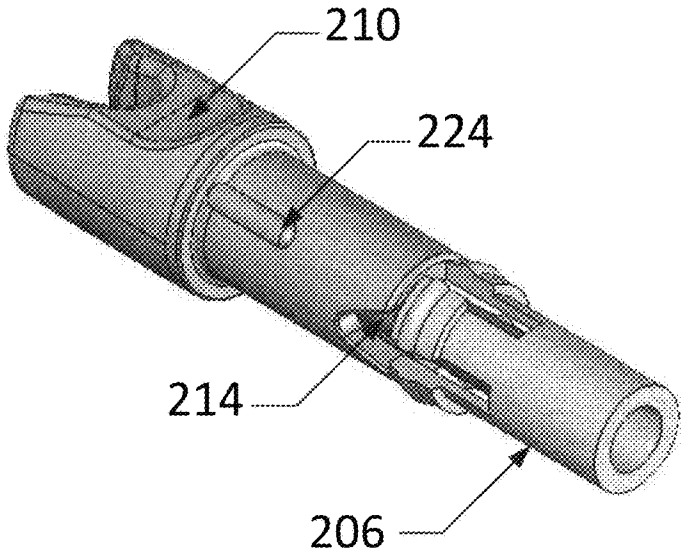
FIG. 33 is a perspective view of a nock system according to certain embodiments.
Figure 32:
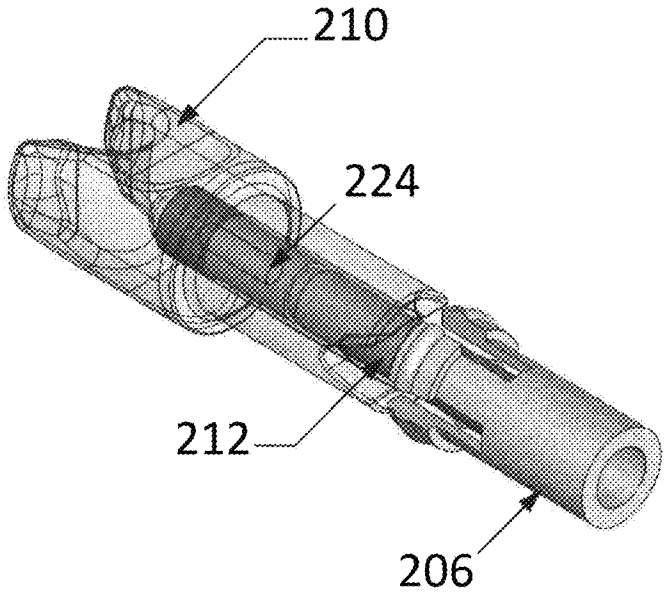
FIG. 32 is a perspective view of a nock system according to certain embodiments showing hidden internal details.

FIGS. 32 and 33 illustrate internal and external details, respectively, of a lightable nock assembly and a non-lightable nock assembly, respectively. FIGS. 34 and 35 are longitudinal cross-sectional views of the lighted and non-lighted nock assemblies of FIGS. 34-35, respectively. Note that the same bushing 204 is used for both lighted and non-lighted variants so that lighted and non-lighted versions of the nock assemblies can be readily swapped for one another.

Figure 36:
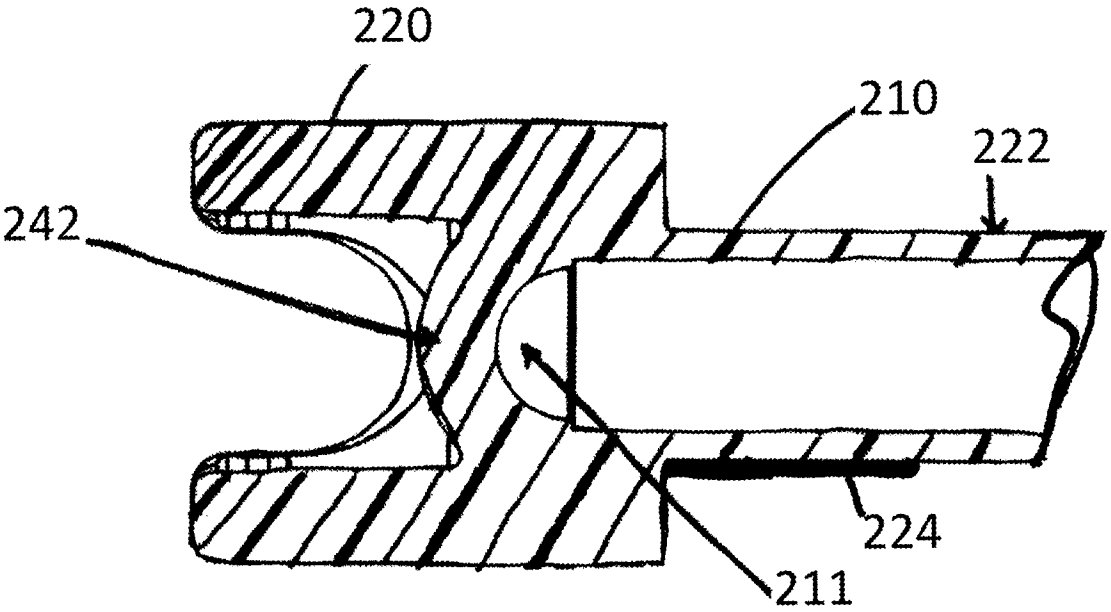
FIG. 36 is a side cross-sectional view of a nock end showing the inclusion of a collimating lens feature according to certain embodiments.

Referring to FIGS. 29-31 and 36, the nock end 210 includes a collimating lens 242. This can be provided in the form of a lens element provided to or disposed within the plastic of the nock end 210, or the collimating lens 242 can be formed unitarily as part of the nock end 210 as shown in FIG. 36.

The collimating lens 242 functions to redirect the light emitted by the LED light source 211 disposed within the nock end 210. The collimating lens 242 feature thus directs more of the available LED light out of the string engaging surface 220 of the nock 210 so that the nock 210, when lighted, appears brighter to the archer when viewed from behind the end of the nock assembly than otherwise would be the case. This is advantageous because the LED light emission can appear brighter to the archer for a given LED output (lumens) or the perceived LED output can be maintained while decreasing the LED's power consumption. An optimized mix of output and consumption characteristics can also be selected.

Figure 38:
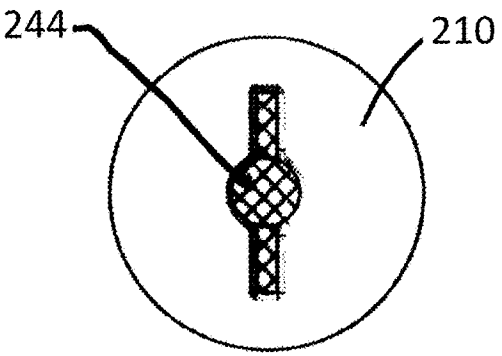
FIG. 38 is an end view of a nock end showing a diffuser in the nock end according to certain embodiments.
Figure 37:
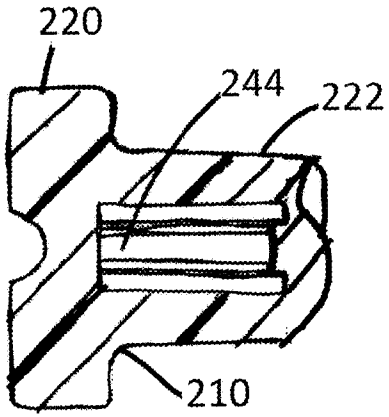
FIG. 37 is a cross-sectional view of a nock end showing a diffuser in the nock end according to certain embodiments.
Figure 39:
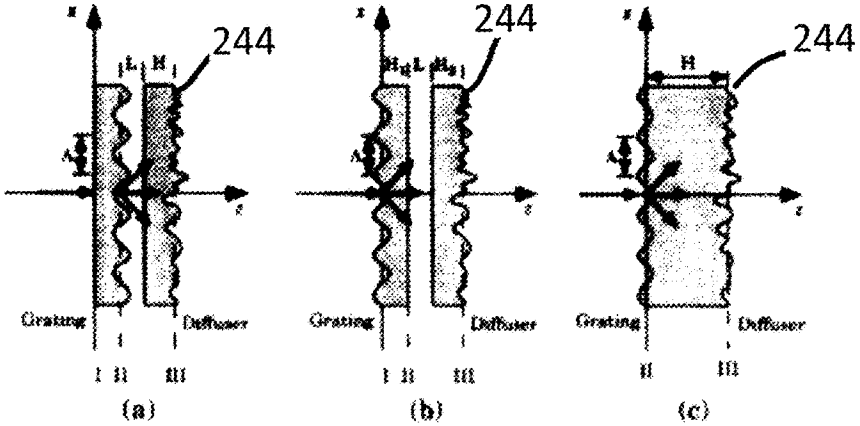
FIG. 39 is a diagram showing a series of different diffuser examples for the nock end according to certain embodiments.

Referring to FIGS. 37-39, in another aspect, a diffuser component 244 can be defined into, disposed within or provided to the nock end 210. The diffuser 244 functions to define a specific beam pattern of the LED light passing through the collimating lens 242. FIG. 39 illustrates additional diffuser 244 configurations.

The distinctive light pattern produced by the diffuser 244 can be beneficial to distinguish one archer's arrow or bolt from another with light patterns that can be circular, square, starburst or any other desired pattern.

Figure 40:
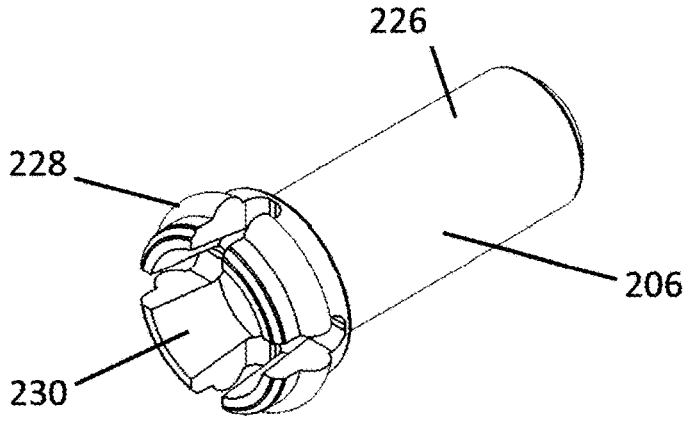
FIG. 40 is a perspective view of a battery stop according to certain embodiments.
Figure 41:
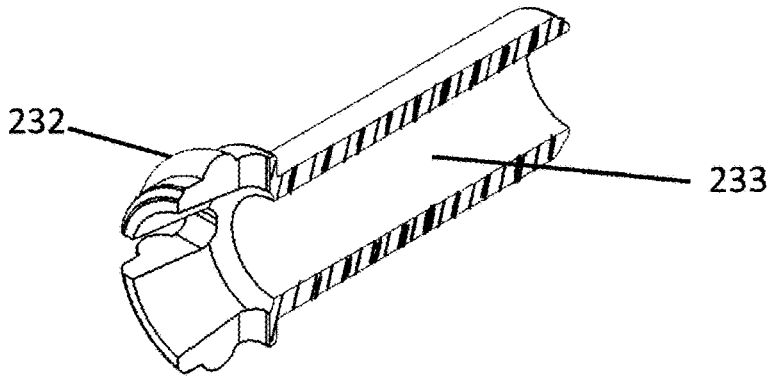
FIG. 41 is a cross-sectional perspective view of a battery stop according to certain embodiments.
Figure 42:
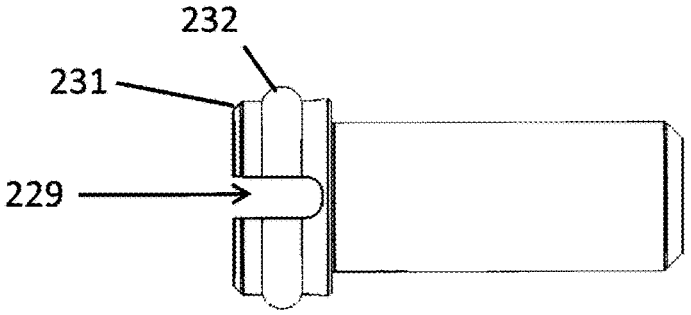
FIG. 42 is a side view of a battery stop according to certain embodiments.

Referring now to FIGS. 40-42 a further embodiment of the battery stop 206 is shown. Here, the channels 229 that define the individual fingers 230 do not extend distally beyond the head 228. This results in a far stiffer spring force as compared to the battery stop of FIGS. 19-22 if all other variables are held constant. There is also an expanded inner surface 233 of the shank portion 226 to permit the battery portion of the battery/LED component to be glued to the battery stop 206. The proximal end also defines a beveled edge 231.

Figure 43:
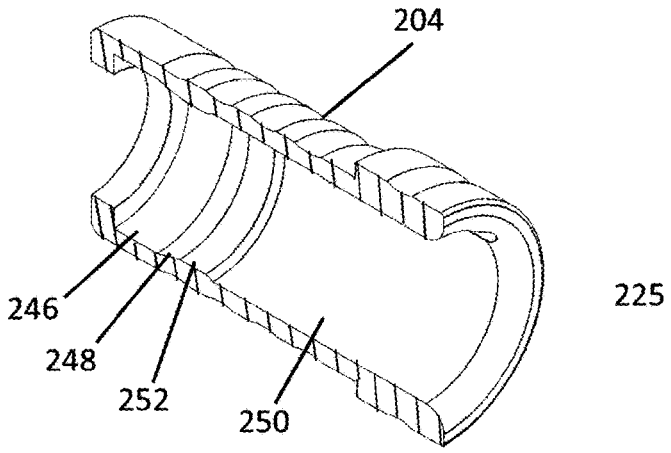
FIG. 43 is a cross-sectional perspective view of a bushing according to certain embodiments.
Figure 44:
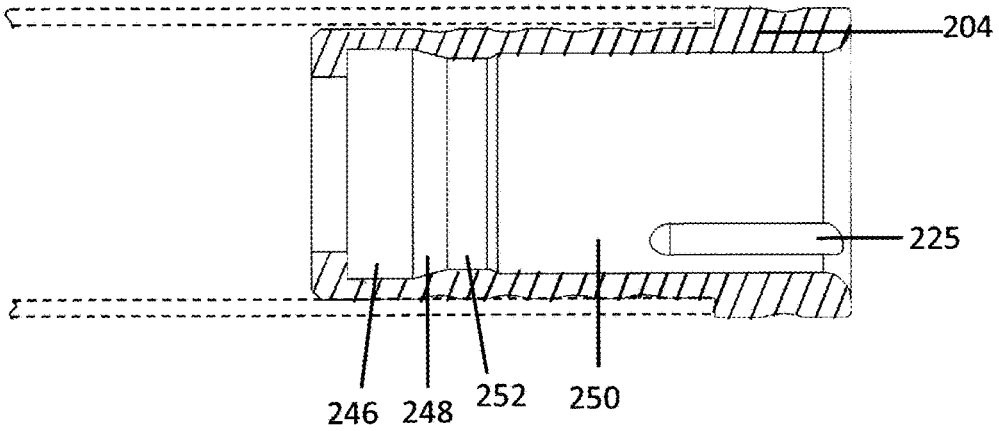
FIG. 44 is a cross-sectional side view of a bushing according to certain embodiments.

Referring to FIGS. 43-44, the bushing 204 defines additional features into the inner surface thereof. As the inner surface of the bushing 204 spans longitudinally from its proximal end towards its distal end, an initial inner diameter region 250 it first defined. Next a region of reduced inner diameter 252 occurs, followed by a sloped inner diameter region 248 that transitions to an expanded inner diameter region 246.

Figure 46:
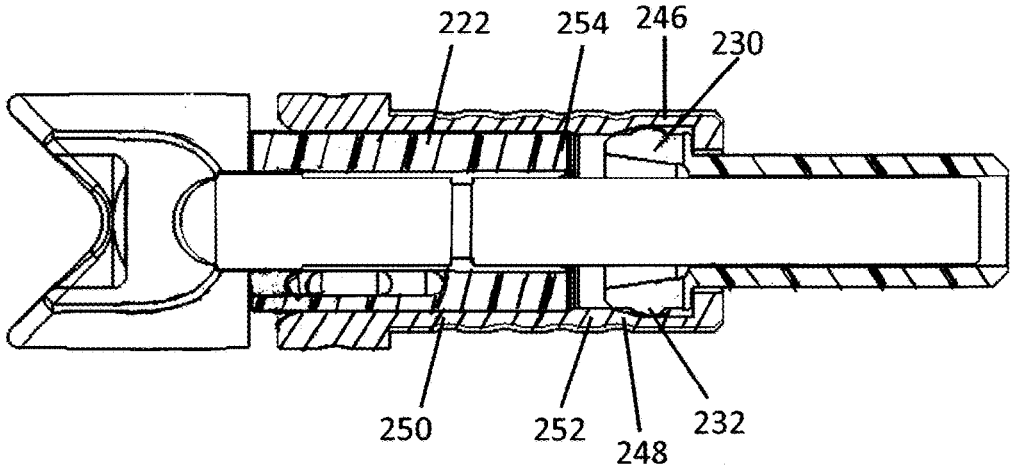
FIG. 46 is a side cross-sectional view of a nock system according to certain embodiments.
Figure 47:
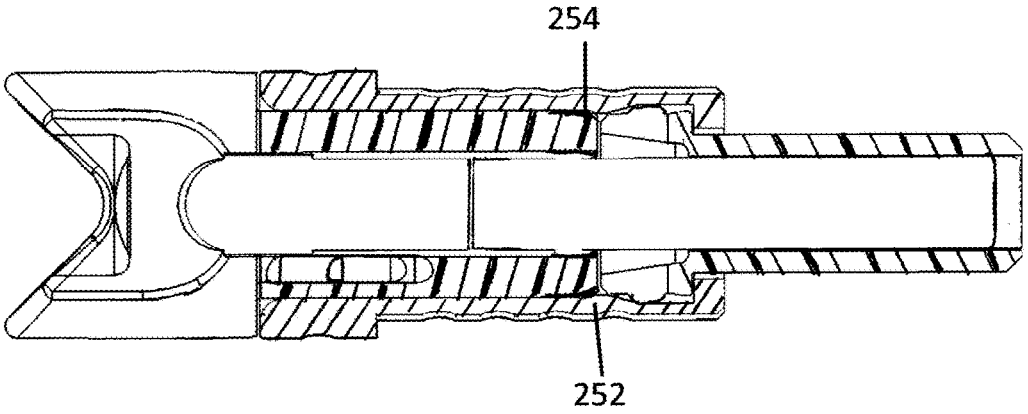
FIG. 47 is another side cross-sectional view of a nock system according to certain embodiments.

The expanded inner diameter region 246, which can also be seen in FIGS. 46-47, is larger than the outer diameter of the nock shank to a degree that the fingers 230 and ribs 232 of the battery stop 206 can expand outward up to or near their diameter in a relaxed state.

A sloped region 248 spans between the expanded inner diameter region 246 and the reduced inner diameter region 252. The slope of the transition between these adjacent regions in one embodiment can be 15 degrees, but other slopes can also be provided. The sloped region 248 eases the force needed to remove the nock assembly as compared to a steep transition such as is the case with square corner or shoulder.

The reduced inner diameter region 252 is longitudinally located between the sloped region 248 and the initial inner diameter region 250. The reduced inner diameter region 252 acts like a cam surface to activate the grooved end of the shank 222 of the nock 210 as will be discussed below.

The different diameter regions discussed above and shown in the figures can be formed by varying the wall thickness of the bushing. This allows the nominal outer diameter of the bushing 204 to remain the same (ignoring the ribbing and texturing, if present) even though the inner diameter is varied.

An index recess 225 is defined into the inner surface of the bushing 204 as already discussed throughout this application.

The arrow shaft or crossbow bolt is shown in dashed lines in FIG. 44.

Figure 45:
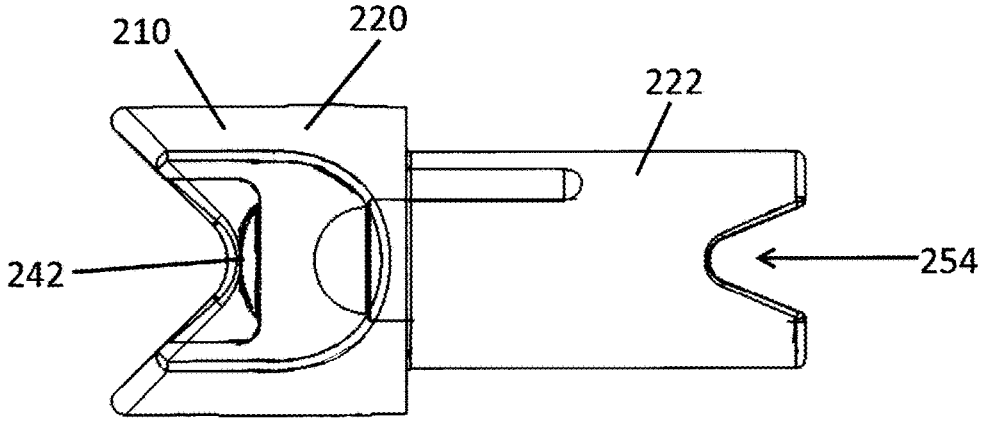
FIG. 45 is a side view of a nock according to certain embodiments.

Referring to FIG. 45, the nock end 210 defines a V-groove 254 into the distal end of the shank portion 222 thereof. This groove 254 is also shown in FIGS. 2, 7, 12, 15-16, 28-31 and 33-35. Note that the collimating lens 242 is also shown in FIG. 45. The V-groove allows the plastic or other material forming the nock end 210 to compress inwards as the distal end of the shank 222 enters the reduced inner diameter region 252 of the bushing 204 during an insertion process. Shapes other than a V-shaped groove can also be provided such that the compression described herein is permitted.

Referring now to FIG. 46, the nock assembly 202 is formed in the manner described previously herein and is inserted into the bushing 204 such that the activation gap is open (i.e., the LED is not lighted). It can be seen in this view that the ribs 232 of the fingers 230 are located in the expanded inner diameter region 246 but the distal end of the shank 222 of the nock 210 has not yet entered the reduced inner diameter region 252.

Referring now to FIG. 47, the nock has been moved further distally to close the activation gap and turn on the LED. In doing this, the grooved portion 254 of the nock shank 222 is compressed inwards by the reduced inner diameter region 252 of the bushing 204. The force for doing this defines the force required to turn the LED on. Of course, turning the LED off would require far less force because the compression of the grooved portion is assisting the proximal movement as the shank is withdrawn from the reduced diameter region 252.

In the foregoing descriptions, it should be apparent that the insertion/removal forces for the nock assembly can be defined independently of the turn on/off forces for the LED. In particular, the force to insert and remove the nock assembly is defined by the flexing of the fingers of the battery stop as it moves through the inner diameters of the bushing while the ON/OFF force for the LED is defined by the movement of the grooved portion 254 of the nock shank 222 into and out of the reduced diameter region 252. Thus, the force to turn ON the LED can be multiple times higher (e.g., 4X) than the force required to turn OFF the LED. Simultaneously, the force required to turn OFF the LED can still be kept less than the force required to remove the nock assembly from the bushing. This is particularly advantageous in situations where a high turn on force is desired to resist forces applied to the nock in the distal direction (i.e., the ON direction) during a loading operation of the bolt or arrow. In such situations, the nock can resist the ON forces during loading, but still be turned off easily, and the removal force for the nock assembly need not be increased due to the keeping the turn-OFF force low.

Figure 48:
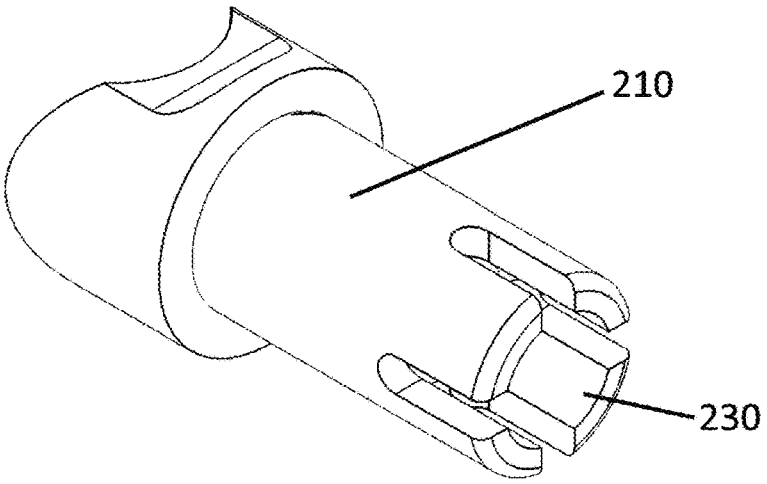
FIG. 48 is a perspective view of a nock according to certain embodiments.
Figure 49:
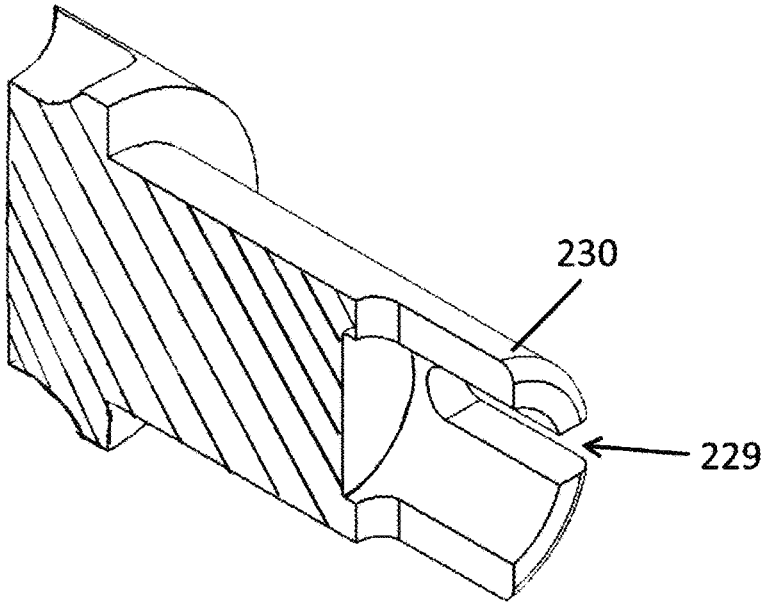
FIG. 49 is a perspective cross-sectional view of a nock according to certain embodiments.

Referring now to FIGS. 48-49, a practice nock embodiment is shown. In this embodiment, the nock 210 is formed of a metal such as aluminum such that it is the same weight as the lighted nock assembly. The practice nock is intended to insert into the same bushing 204 as the lighted nock assembly so that the user can use their same arrow shaft or crossbow bolt. No battery stop component is required because the distal end of the nock defines one or more grooves 229 to define fingers 230. When the practice nock is fully inserted into the bushing, the fingers deflect inwards due to the narrowed inner diameter 252 of the bushing 204 to create sufficient retention force to keep the practice nock seated in the bushing 204. The practice nock 210 can be easily withdrawn out of the bushing without damaging the bushing or shaft/bolt.

The present invention can be combined into a kit (assembled or unassembled) including one or more arrow shafts, bolts and/or arrow heads and any other components discussed herein.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. An archery nock system, comprising:

a bushing having a hollow interior, a proximal end and a distal end opposite the proximal end, the hollow interior defining a first inner diameter region, a reduced inner diameter region, a sloped inner diameter region and an expanded inner diameter region; and a nock assembly defining an outer shape that permits a portion of the nock assembly to be disposed within the hollow interior of the bushing via insertion through the proximal end of the bushing, wherein a diameter of the reduced inner diameter region is smaller than a diameter of the first inner diameter region, wherein the diameter of the reduced inner diameter region is smaller than a diameter of the expanded inner diameter region, wherein the first inner diameter region is located longitudinally between the reduced inner diameter region and the proximal end of the bushing, wherein the expanded inner diameter region is located longitudinally between the reduced inner diameter region and the distal end of the bushing, and wherein the sloped inner diameter region spans longitudinally between the reduced inner diameter region and the expanded inner diameter region.

2. The archery nock of claim 1, wherein a diameter of the first inner diameter region is smaller than the diameter of the expanded inner diameter region.

3. The archery nock of claim 1, wherein an aperture defined at the proximal end of the bushing has a diameter that is the same as the diameter of the first inner diameter region.

4. The archery nock of claim 1, wherein the sloped inner diameter region has a slope of 15 degrees.

5. The archery nock of claim 1, wherein the nock assembly includes a light emitting diode disposed within the nock assembly.

6. The archery nock of claim 1, wherein the hollow interior of the bushing further defines a first registration feature and the nock assembly defines a complimentary second registration feature configured to engage the first registration feature of the bushing while the nock assembly is being inserted into the proximal end of the bushing in a correct axial orientation.

7. The archery nock of claim 6, wherein the nock assembly includes a lighted nock and wherein the first and second registration features are configured to maintain the correct axial orientation while a nock end of the nock assembly is moved longitudinally towards and away from the proximal end of the bushing to turn the lighted nock on and off.

8. The archery nock of claim 1, wherein the hollow interior of the bushing further defines a longitudinally extending recess and the nock assembly defines a longitudinally-oriented raised rib sized to engage the longitudinally extending recess while the nock assembly is being inserted into the proximal end of the bushing in a correct axial orientation.

9. The archery nock of claim 1, wherein the nock assembly comprises a nock end that includes a collimating lens disposed therein.

10. The archery nock of claim 1, wherein the nock assembly comprises:

a battery stop;

a nock end; and a battery/LED component including an LED portion and a battery portion, wherein the LED portion is secured inside of the nock end, wherein the battery portion is secured inside of the battery stop, wherein the nock end is linearly movable towards and away from the battery stop to turn the LED on and off.

11. The archery nock of claim 10, wherein the battery stop comprises a head portion and a shank portion, wherein a plurality of grooves are defined longitudinally into the head portion, which define a plurality of flexible finger portions.

12. The archery nock of claim 11, wherein each of the plurality of flexible finger portions includes an outer rib.

13. The archery nock of claim 11, wherein the nock end includes a string engaging portion and a shank portion, and wherein the shank portion includes a compression groove defined longitudinally into the shank portion from an end of the shank portion.

14. The archery nock of claim 10, wherein the nock assembly further includes a stop tab disposed in an activation gap defined axially into the nock assembly.

15. A method of using an archery nock with a hollow bushing that is installed into an arrow shaft or a crossbow bolt, the method comprising:

setting a minimum insertion force required to seat the archery nock in the hollow bushing;

setting a minimum removal force required to remove the archery nock from the hollow bushing;

setting a minimum turn ON force required to turn ON an LED disposed within the archery nock;

setting a minimum turn OFF force required to turn the LED OFF, wherein the minimum turn ON force is greater than each of the minimum turn OFF force, the minimum insertion force and the minimum removal force, and wherein the minimum removal force is greater than the minimum turn OFF force;

inserting the archery nock into the hollow bushing with at least the minimum insertion force;

turning an LED ON by pushing a nock end portion of the archery nock in a direction towards the hollow bushing with at least the minimum turn ON force;

turning the LED OFF by pulling the nock end portion in a direction away from the hollow bushing with at least the minimum turn OFF force; and removing the archery nock from the hollow bushing by pulling the nock end portion in the direction away from the hollow bushing with at least the minimum removal force.

16. The method of claim 15, wherein the minimum turn ON force is multiple times greater than the minimum turn OFF force.

17. The method of claim 15, further comprising collimating light emitted by the LED when in an ON state with a collimating lens provided to the nock end portion of the archery nock.

18. The method of claim 15, further comprising passing light emitted by the LED through a diffuser provided to the nock end portion of the archery nock.

19. The method of claim 15, further comprising, after removing the archery nock from the hollow bushing, inserting a non-lightable nock assembly into the hollow bushing.

20. The method of claim 15, wherein the step of setting the minimum turn ON force includes compressing a grooved end of a shank of the nock end portion with a reduced inner diameter region defined by an inner surface of the hollow bushing.

* * * * *